US007492343B2

(12) United States Patent
Kang et al.

(10) Patent No.: US 7,492,343 B2
(45) Date of Patent: Feb. 17, 2009

(54) LIQUID CRYSTAL DISPLAY DEVICE

(75) Inventors: Sin Ho Kang, Suwon-si (KR); Jin Cheol Hong, Kumi-si (KR); Seung Kuk An, Kumi-si (KR); Hong Sung Song, Kumi-si (KR)

(73) Assignee: LG Display Co., Ltd., Seoul (KR)

( * ) Notice: Subject to any disclaimer, the term of this patent is extended or adjusted under 35 U.S.C. 154(b) by 840 days.

(21) Appl. No.: 10/964,780

(22) Filed: Oct. 15, 2004

(65) Prior Publication Data

US 2005/0140618 A1 Jun. 30, 2005

(30) Foreign Application Priority Data

Dec. 11, 2003 (KR) ..... 10-2003-0090301
Apr. 28, 2004 (KR) ..... 10-2004-0029615

(51) Int. Cl.
*G09G 3/36* (2006.01)

(52) U.S. Cl. ..... 345/100

(58) Field of Classification Search ..... 345/55–100, 345/204–214

See application file for complete search history.

(56) References Cited

U.S. PATENT DOCUMENTS 5,363,424 A 11/1994 Fujisawa
5,440,304 A 8/1995 Hirai
6,232,940 B1 * 5/2001 Ohno et al. ..... 345/94
6,278,509 B1 8/2001 Ohga et al.
6,335,720 B1 * 1/2002 Mori et al. ..... 345/98
6,590,559 B2 7/2003 Takabayashi et al.
7,167,153 B2 1/2007 Kimura et al.

FOREIGN PATENT DOCUMENTS

CN 1180 418 A 4/1998
CN 1198540 A 11/1998
JP 4-168417 6/1992
JP 7-261711 10/1995
JP 11-311763 11/1999
JP 2002-278492 9/2002

* cited by examiner

*Primary Examiner*—David L Lewis
(74) *Attorney, Agent, or Firm*—McKenna Long & Aldridge LLP

(57) ABSTRACT

A liquid crystal display device for improving working efficiency and reducing manufacturing cost. In the device, a data integrated circuit has a data output group for supplying pixel data to data lines and a dummy data output channel group which is not supplied with pixel data. A channel selector selects an output channel of the data output channel group. A tape carrier package is mounted with the data integrated circuit and has a data output pad group connected to the data output channel group and a dummy output pad group. The pixel data is applied, via the data output channels selected by the channel selector, to the data lines.

37 Claims, 24 Drawing Sheets

LIQUID CRYSTAL DISPLAY DEVICE

This application claims the benefit of Korean Patent Application No. P2003-90301, filed Dec. 11, 2003, and P2004-29615 filed on Apr. 28, 2004, which are hereby incorporated by reference for all purposes as if fully set forth herein.

BACKGROUND OF THE INVENTION

1. Field of the Invention

This invention relates to a liquid crystal display, and more particularly to a liquid crystal display device that is adaptive for improving working efficiency as well as reducing manufacturing costs.

2. Description of the Related Art

Generally, a liquid crystal display (LCD) controls a light transmittance of a liquid crystal using an electric field to thereby display a picture.

To achieve this, as illustrated in FIG. 1, the LCD includes a matrix-type liquid crystal display panel 2, in which liquid crystal cells are arranged in a matrix, a gate driver 6 for driving gate lines GL1 to GLn of the liquid crystal display panel 2, a data driver 4 for driving data lines DL1 to DLm of the liquid crystal display panel 2, and a timing controller 8 for controlling the gate driver 6 and the data driver 4.

The liquid crystal display panel 2 includes a thin film transistor TFT provided at each intersection between the gate lines GL1 to GLn and the data lines DL1 to DLm, and a liquid crystal cell 7 connected to the thin film transistor TFT. The thin film transistor TFT is turned on when it is supplied with a scanning signal, that is, a gate high voltage VGH from the gate line GL, to thereby apply a pixel signal from the data line DL to the liquid crystal cell 7. Further, the thin film transistor TFT is turned off when it is supplied with a gate low voltage VGL from the gate line GL, to thereby keep a pixel signal charged in the liquid crystal cell 7.

The liquid crystal cell 7 can be equivalently expressed as a liquid crystal capacitor. The liquid crystal cell 7 includes a pixel electrode connected to a common electrode and a thin film transistor with a liquid crystal therebetween. Further, the liquid crystal cell 7 includes a storage capacitor for the purpose of maintaining the charge of the pixel signal until the next pixel signal is charged. This storage capacitor is provided between the pixel electrode and the pre-stage gate line. Such a liquid crystal cell 7 varies an alignment state of the liquid crystal, which has a dielectric anisotropy, in accordance with a pixel signal charged through the thin film transistor TFT to control a light transmittance, thereby implementing gray scale levels.

The timing controller 8 generates gate control signals (i.e., GSP, GSC and GOE) and data control signals (i.e., SSP, SSC, SOE and POL) using synchronizing signals V and H supplied from a video card (not illustrated). The gate control signals (i.e., GSP, GSC and GOE) are applied to the gate driver 6 to control the gate driver 6 while the data control signals (i.e., SSP, SSC, SOE and POL) are applied to the data driver 4 to control the data driver 4. Further, the timing controller 8 aligns red (R), green (G) and blue (B) pixel data VD and applies them to the data driver 4.

The gate driver 6 drives the gate lines GL1 to GLn sequentially. To achieve this, the gate driver 6 includes a plurality of gate integrated circuits (IC's) 10 as illustrated in FIG. 2A. The gate IC's 10 sequentially drive the gate lines GL1 to GLn connected thereto under control of the timing controller 8. In other words, the gate IC's 10 sequentially apply a gate high voltage VGH to the gate lines GL1 to GLn in response to the gate control signals (i.e., GSP, GSC and GOE) from the timing controller 8.

More specifically, the gate driver 6 shifts a gate start pulse GSP in response to a gate shift clock GSC to generate a shift pulse. Then, the gate driver 6 applies a gate high voltage VGH to the corresponding gate line GL every horizontal period in response to the shift pulse. In other words, the shift pulse is shifted line-by-line every horizontal period, and any one of the gate IC's 10 applies the gate high voltage VGH to the corresponding gate line GL in correspondence with the shift pulse. In particular, the gate IC's supply a gate low voltage VGL in the interval remaining when the gate high voltage VGH is not supplied to the gate lines GL1 to GLn.

The data driver 4 applies pixel signals for each one line to the data lines DL1 to DLm every horizontal period. To achieve this, the data driver 4 includes a plurality of data IC's 16 as illustrated in FIG. 2B. The data IC's 16 apply pixel signals to the data lines DL1 to DLm in response to data control signals (i.e., SSP, SSC, SOE and POL) from the timing controller 8. In particular, the data IC's 16 convert pixel data VD from the timing controller 8 into analog pixel signals using a gamma voltage from a gamma voltage generator (not illustrated).

More specifically, the data IC's 16 shift a source start pulse SSP in response to a source shift clock SSC to generate sampling signals. Then, the data. IC's 16 sequentially latch the pixel data VD for a certain unit in response to the sampling signals. Thereafter, the data IC's 16 convert the latched pixel data VD for one line into analog pixel signals and apply them to the data lines DL1 to DLm in an enable interval of a source output enable signal SOE. In particular, the data IC's 16 convert the pixel data VD into positive or negative pixel signals in response to a polarity control signal POL.

To accomplish this, as illustrated in FIG. 3, each of the data IC's 16 includes a shift register part 34 for applying sequential sampling signals, a latch part 36 for sequentially latching the pixel data VD in response to the sampling signals to output them simultaneously, a digital-to-analog converter (DAC) 38 for converting the pixel data VD from the latch part 38 into pixel voltage signals, and an output buffer part 46 for buffering pixel voltage signals from the DAC 38 to output them. Further, the data IC 16 includes a signal controller 20 for interfacing various control signals (i.e., SSP, SSC, SOE, REV and POL, etc.) from the timing controller 8 and the pixel data VD, and a gamma voltage part 32 for supplying positive and negative gamma voltages required for the DAC 38.

The signal controller 20 controls various control signals (i.e., SSP, SSC, SOE, REV and POL, etc.) from the timing controller 8 and the pixel data VD in order to output them to the corresponding elements.

The gamma voltage part 32 subdivides a plurality of gamma reference voltages inputted from a gamma reference voltage generator (not illustrated) for each gray level to output them.

Shift registers included in the shift register part 34 sequentially shift a source start pulse SSP from the signal controller 20 in response to a source sampling clock signal SSC to output it as a sampling signal.

The latch part 36 sequentially samples the pixel data VD from the signal controller 20 for a certain unit in response to the sampling signals from the shift register part 34 to latch them. To achieve this, the latch part 36 is comprised of i latches (wherein i is an integer) so as to latch i pixel data VD, and each of latches has a dimension corresponding to the bit number of the pixel data VD. Particularly, the timing controller 8 divides the pixel data VD into even pixel data VDeven and odd pixel data VDodd so as to reduce a transmission frequency and simultaneously outputs them through each transmission line. Herein, each of the even pixel data VDeven and the odd pixel data VDodd includes red(R), green(G) and blue(B) pixel data. Thus, the latch part 36 simultaneously latches the even pixel data VDeven and the odd pixel data VDodd supplied via the signal controller 20 for each sampling signal. Then, the latch part 36 simultaneously outputs i latched pixel data VD in response to a source output enable signal SOE from the signal controller 20.

In particular, the latch part 36 restores pixel data VD modulated such that the transition bit number is reduced in response to a data inversion selection signal REV to output them. The timing controller 8 modulates the pixel data VD such that the number of transition bits are minimized using a reference value to determine whether the bits should be inverted: or not. This minimizes an electromagnetic interference (EMI) upon data transmission due to a minimal number of bit transitions from LOW to HIGH or HIGH to LOW.

The DAC 38 simultaneously converts the pixel data VD from the latch part 36 into positive and negative pixel voltage signals to output them. To achieve this, the DAC 38 includes a positive (P) decoding part 40 and a negative (N) decoding part 42 commonly connected to the latch part 36, and a multiplexer (MUX) part 44 for selecting output signals of the P decoding part 40 and the N decoding part 42.

A number n of P decoders included in the P decoding part 40 convert n pixel data inputted simultaneously from the latch part 36 into positive pixel voltage signals using positive gamma voltages from the gamma voltage part 32. A number i of N decoders included in the N decoding part 42 convert i pixel data inputted simultaneously from the latch part 36 into negative pixel voltage signals using negative gamma voltages from the gamma voltage part 32. A number i of multiplexers included in the multiplexer part 44 selectively output the positive pixel voltage signals from the P decoder 40 or the negative pixel voltage signals from the N decoder 42 in response to a polarity control signal POL from the signal controller 20.

A number i output buffers included in the output buffer part 46 are comprised of voltage followers, etc. connected, in series, to the respective i data lines DL1 to DLi. Such output buffers buffer pixel voltage signals from the DAC 38 to apply them to the data lines DL1 to DLi.

Such an LCD differentiates output channels of the data IC's 16 included in the data driver 4 depending upon a resolution of the liquid crystal display panel 2. This is because the data IC's 16 that have certain channels being connectable to the data lines DL for each resolution of the liquid crystal display panel 2 are differentiated from other. Thus, because a different number of data IC's 16 having different output channels for each resolution of the liquid crystal display panel 2 need to be used. This reduces working efficiency and increases manufacturing cost.

More specifically, for a liquid crystal display having a resolution of an eXtended Graphics Array (XGA) display with 3072 data lines DL (1024 horizontal pixels×3 colors, red, green, and blue), it requires four data IC's 16, each of which has 768 data output channels. For a liquid crystal display having a resolution of a Super eXtended Graphics Adapter+ (SXGA+) display with 4200 data lines DL (1400 horizontal pixels×3 colors, red, green, and blue)), it requires six data IC's 16, each of which has 702 data output channels. In this case, the remaining 12 data output channels are dummy lines. For a liquid crystal display having a resolution of a Wide eXtended Graphics Array (WXGA) display with 3840 data lines DL (1280 horizontal pixels×3 colors, red green, and blue), it requires six data IC's 16, each of which has 642 data output channels. In this case, the remaining 12 data output channels are dummy lines.

As mentioned above, a different data IC's 16 having a specific number of output channels have to be used for each resolution type of the related art liquid crystal display panel 2. As a result, the related liquid crystal display has a reduced working efficiency and manufacturing cost is increased.

SUMMARY OF THE INVENTION

Accordingly, the present invention is directed to a liquid crystal display device that substantially obviates one or more problems due to limitations and disadvantages of the related art.

Accordingly, the present invention to provide a liquid crystal display device with improved working efficiency as well as reduced manufacturing cost.

Another advantage of the present invention is to a liquid crystal display device that is capable of controlling output channels of data integrated circuits based upon a resolution type of a liquid crystal display panel.

To achieve these and other advantages of the invention, a liquid crystal display device according to an embodiment of the present invention includes a data integrated circuit having a data output group for supplying pixel data to data lines and provided with a dummy output channel group; a channel selector for selecting an output channel of the data output channel group; and a tape carrier package mounted with the data integrated circuit and having a data output pad group connected to the data output channel group and a dummy data output pad group, wherein said pixel data is applied, via the data output channels selected by the channel selector, to the data lines.

A liquid crystal display device according to another embodiment of the present invention includes a data integrated circuit having first and second data output channel groups for supplying pixel data to data lines and having a dummy output channel group located between the first and second data output channel groups; a channel selector for selecting output channels of the data output channel groups; and a tape carrier package mounted with the data integrated circuit and having first and second data output pad groups connected to the first and second data output channel groups, wherein said pixel data is applied, via the data output channels elected by the channel selector, to the data lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding: of the invention and are incorporated in and constitute a part of this specification, illustrate embodiments of the invention and together with the description serve to explain the principles of the invention.

In the drawings.

DETAILED DESCRIPTION OF THE EMBODIMENTS

Reference will now be made in detail to embodiments of the present invention, examples of which are illustrated in the accompanying drawings.

Figure 1:
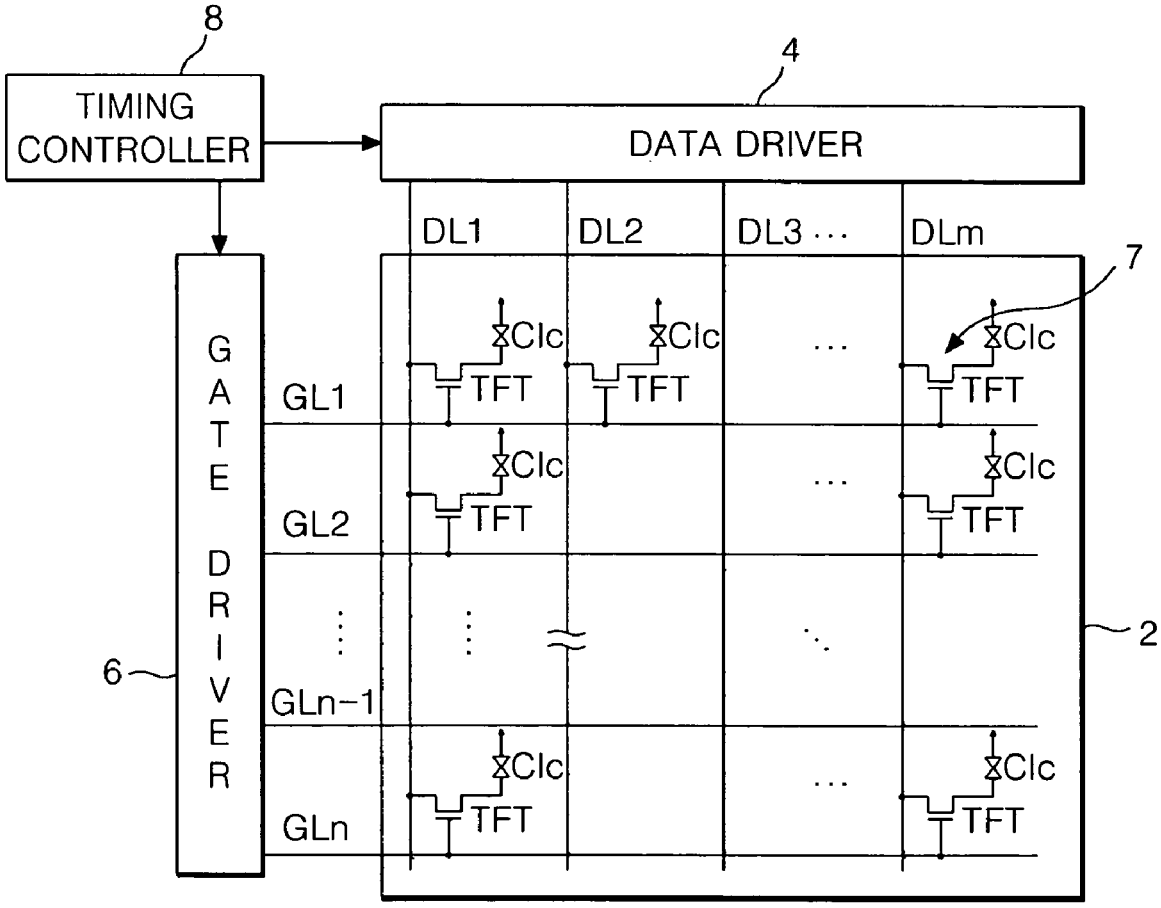
FIG. 1 RELATED ART
FIG. 1 is a block circuit diagram illustrating a related art liquid crystal display.
Figure 2A:
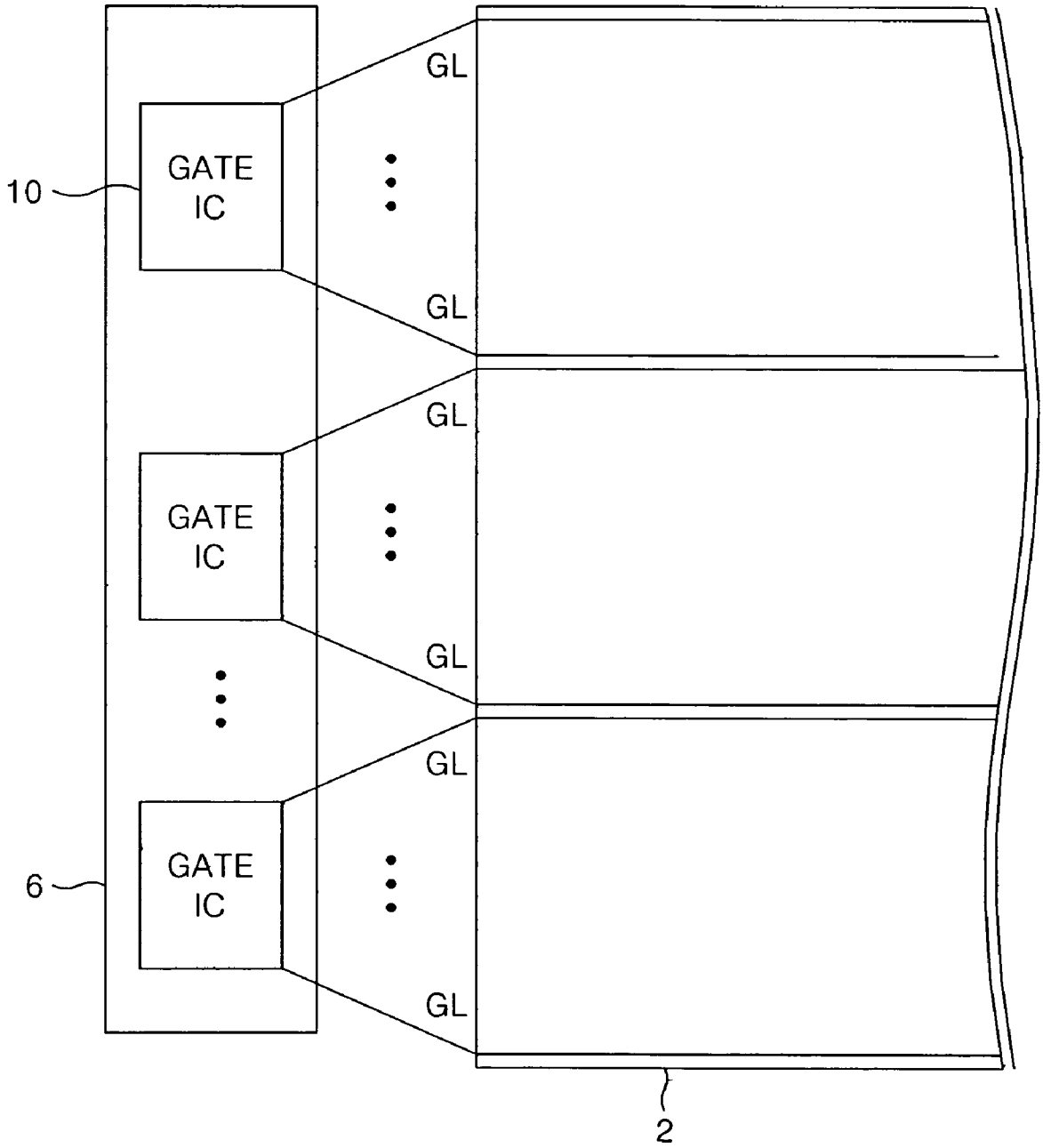
FIG.2A RELATED ART
FIG. 2A illustrates gate integrated circuits included in a related art gate driver.
Figure 2B:
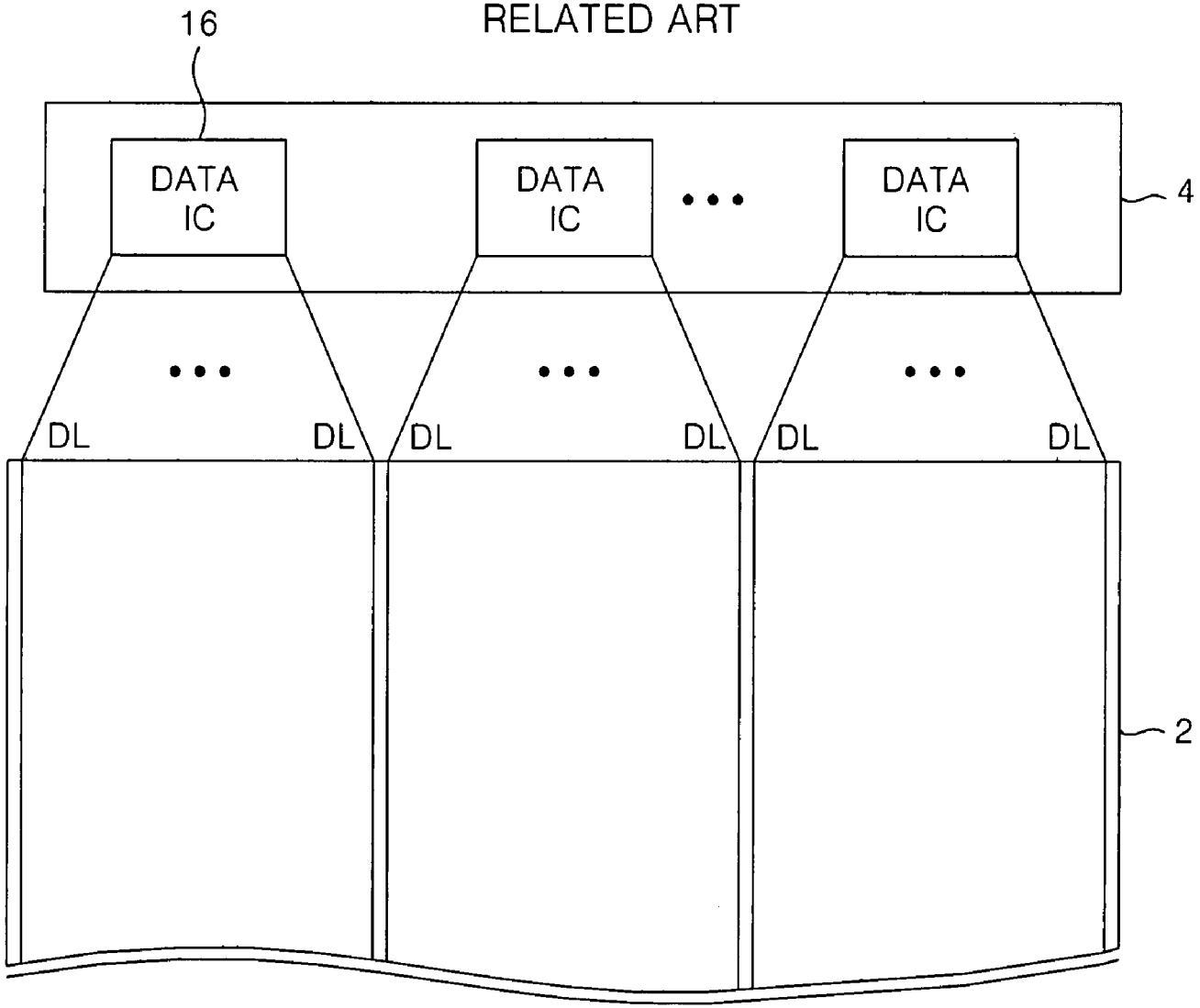
FIG.2B RELATED ART
FIG. 2B illustrates data integrated circuits included in a related art data driver.
Figure 3:
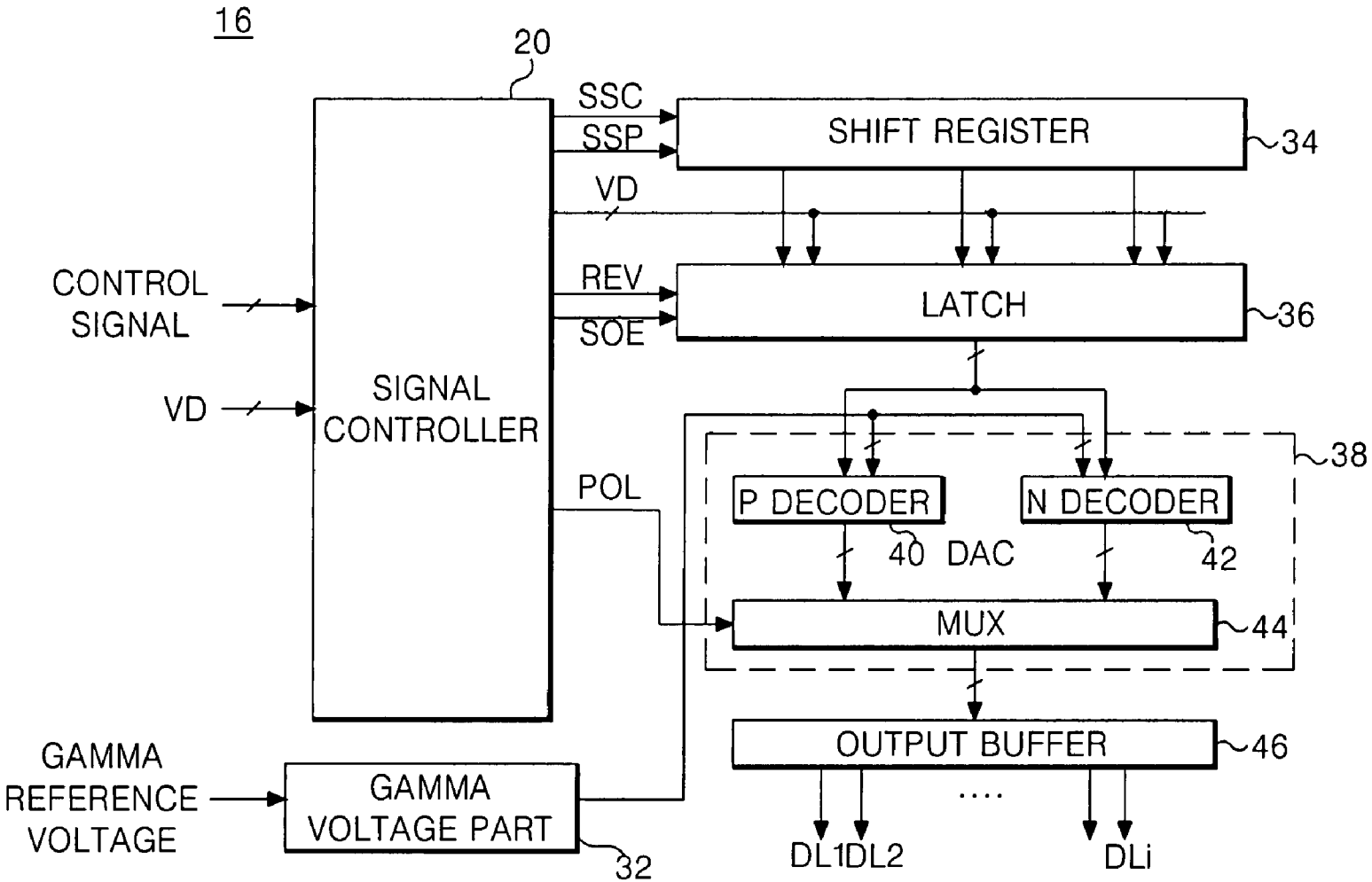
FIG.3 RELATED ART
FIG. 3 is a block diagram illustrating an internal configuration of the data integrated circuit in FIG. 2B.
Figure 4:
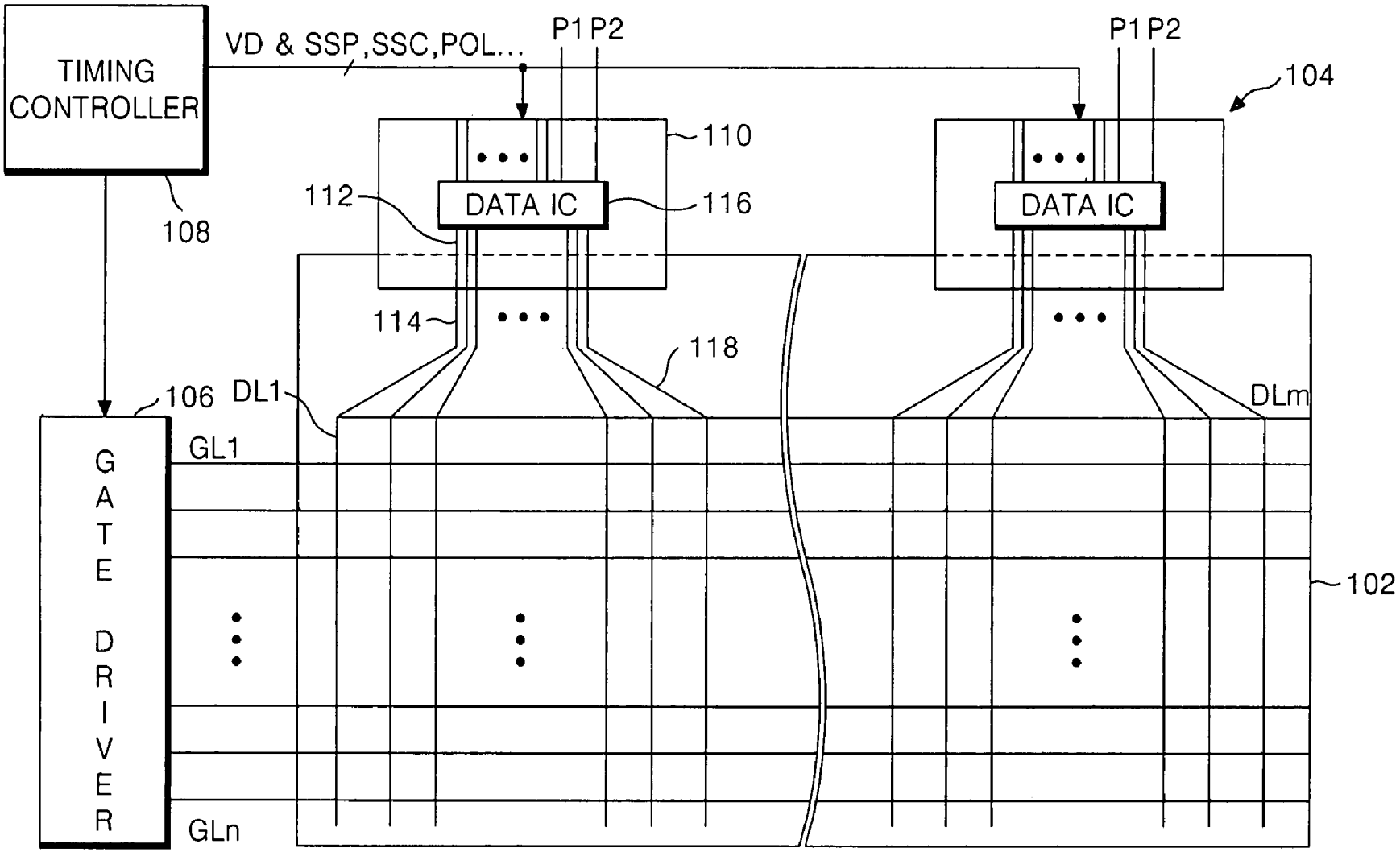
FIG. 4 is a block circuit diagram illustrating a liquid crystal display according to a first embodiment of the present invention.

FIG. 4 schematically shows a liquid crystal display (LCD) according to a first exemplary embodiment of the present invention. It is understood that the present invention contemplates embodiments other than those discussed herein as well.

Referring to FIG. 4, the LCD includes a liquid crystal display panel 102 having liquid crystal cells arranged in a matrix type, a gate driver 106 for driving gate lines GL1 to GLn of the liquid crystal display panel 102, a data driver 104 for driving data lines DL1 to DLm of the liquid crystal display panel 102, and a timing controller 108 for controlling the gate driver 106 and the data driver 104.

The liquid crystal display panel 102 includes a thin film transistor TFT provided at each intersection between the gate lines GL1 to GLn and the data lines DL1 to DLm, and a liquid crystal cell (not illustrated) connected to the thin film transistor TFT. The thin film transistor TFT is turned on when it is supplied with a scanning signal, that is, a gate high voltage VGH from the gate line GL, to apply a pixel signal from the data line DL to the liquid crystal cell. Further, the thin film transistor TFT is turned off when it is supplied with a gate low voltage VGL from the gate line GL. The pixel signal remains charged in the liquid crystal cell.

The liquid crystal cell can be equivalently expressed as a liquid crystal capacitor. The liquid crystal cell includes a pixel electrode connected with a common electrode and a thin film transistor with a liquid crystal therebetween. Further, the liquid crystal cell includes a storage capacitor for the purpose of maintaining the charged pixel signal until the next pixel signal is charged. This storage capacitor is provided between the pixel electrode and the pre-stage gate line. Such a liquid crystal cell 7 varies an alignment state of the liquid crystal having a dielectric anisotropy in accordance with a pixel signal charged through the thin film transistor TFT to control a light transmittance, thereby implementing gray scale levels.

The timing controller 108 generates gate control signals (i.e., GSP, GSC and GOE) and data control signals (i.e., SSP, SSC, SOE and POL) using synchronizing signals V and H supplied from a video card (not illustrated). The gate control signals (i.e., GSP, GSC and GOE) are applied to the gate driver 106 to control the gate driver 106 while the data control signals (i.e., SSP, SSC, SOE and POL) are applied to the data driver 104 to control the data driver 104. Further, the timing controller 108 aligns pixel data VD and applies them to the data driver 104.

The gate driver 106 sequentially drives the gate lines GL1 to GLn. To achieve this, the gate driver 106 includes a plurality of gate integrated circuits (IC's) (not illustrated). The gate IC's sequentially drive the gate lines GL1 to GLn connected thereto under control of the timing controller 108. In other words, the gate IC's sequentially apply a gate high voltage VGH to the gate lines GL1 to GLn in response to the gate control signals (i.e., GSP, GSC and GOE) from the timing controller 108.

More specifically, the gate driver 106 shifts a gate start pulse GSP in response to a gate shift clock GSC to generate a shift pulse. Then, the gate driver 106 applies a gate high voltage VGH to the corresponding gate line GL every horizontal period in response to the shift pulse. In other words, the shift pulse is shifted line-by-line every horizontal period, and any one of the gate IC's applies the gate high voltage VGH to the corresponding gate line GL in accordance with the shift pulse. In particular, the gate IC's supply a gate low voltage VGL in the remaining gate lines.

The data driver 104 applies pixel signals to the data lines DL1 to DLm one at a time every horizontal period. To achieve this, the data driver 104 includes a plurality of data IC's 116. Each of the data IC's 116 is mounted in a data tape carrier package (TCP) 110. Such data IC's 116 are electrically connected, via a data TCP pad 112, a data pad 114 and a link 118, to the data lines DL1 to DLm. The data IC's 116 apply pixel signals to the data lines DL1 to DLm in response to data control signals (i.e., SSP, SSC, SOE and POL) from the timing controller 108. In particular, the data IC's 116 convert pixel data VD from the timing controller 108 into analog pixel signals using gamma voltages from a gamma voltage generator (not illustrated).

More specifically, the data IC's 116 shift a source start pulse SSP in response to a source shift clock SSC to generate sampling signals. Then, the data IC's 116 sequentially latch the pixel data VD for a certain unit in response to the sampling signals. Thereafter, the data IC's 16 convert the latched pixel data VD for one line into analog pixel signals, and apply them to the data lines DL1 to DLm in an enable interval of a source output enable signal SOE. In particular, the data IC's 116 convert the pixel data VD into positive or negative pixel signals in response to a polarity control signal POL.

Meanwhile, each of the data IC's 116 of the LCD according to the first embodiment of the present invention varies an output channel for applying a pixel signal to each data line DL1 to DLm in response to first and second channel selection signals P1 and P2 input from the exterior thereof. To achieve this, each of the data IC's 116 includes first and second option pins OP1 and OP2, for example, supplied with the first and second channel selection signals P1 and P2.

Each of the first and second option pins OP1 and OP2 is selectively connected to a voltage source VCC and a ground voltage source GND to have a 2-bit binary logical value. Thus, the first and second channel selection signals P1 and P2 apply, via the first and second option pins OP1 and OP2, logical values of '00', '01', '10' and '11' to the data IC 116.

Accordingly, each of the data IC's 116 has the number of output channel set in advance depending on a resolution of the liquid crystal display panel 102 using first and second channel selection signals P1 and P2 applied via the first and second option pins OP1 and OP2.

The number of data IC's 116 according to output channels of the data IC's 116 depending upon a resolution of the liquid crystal display panel 102 is described in the following Table:

TABLE 1

| | Pixel number | | The number of data IC's according to output channels of data IC's | | | |
|---|---|---|---|---|---|---|
| Resolution | Data line | Gate line | 600CH | 618CH | 630CH | 642CH |
| XGA | 3072 | 768 | 5.12 | 4.97 | 4.88 | 4.79 |
| SXGA+ | 4200 | 1050 | 7.00 | 6.80 | 6.67 | 6.54 |
| UXGA | 4800 | 1200 | 8.00 | 7.77 | 7.62 | 7.48 |
| WXGA | 3840 | 800 | 6.40 | 6.21 | 6.10 | 5.98 |
| WSXGA– | 4320 | 900 | 7.20 | 6.99 | 6.86 | 6.73 |
| WSXGA | 5040 | 1050 | 8.40 | 8.16 | 8.00 | 7.85 |
| WUXGA | 5760 | 1200 | 9.60 | 9.32 | 9.14 | 8.97 |

Referring to the above Table 1, it can be seen that all resolutions can be expressed by four channels. More specifically, the liquid crystal display panel 102 having a resolution of XGA requires five data IC's 116, each of which has 618 data output channels. In particular, the remaining 18 data output channels are treated into dummy lines. The liquid crystal display panel 102 having a resolution of SXGA+ requires seven data IC's 116, each of which has 600 data output channels. The liquid crystal display panel 102 having a resolution of Ultra eXtended Graphics Adapter (UXGA) requires eight data IC's 116, each of which has 600 data output channels. The liquid crystal display panel 102 having a resolution of WXGA requires six data IC's 116, each of which has 642 data output channels. The liquid crystal display panel 102 having a resolution of Wide aspect Super eXtended Graphics Adapter—(WSXGA-) requires seven data IC's 116, each of which has 618 data output channels. The liquid crystal display panel 102 having a resolution of Wide aspect Super eXtended Graphics Adapter (WSXGA) requires eight data IC's 116, each of which has 630 data output channels. The liquid crystal display panel 102 having a resolution of Wide aspect Ultra eXtended Graphics Adapter (WUXGA) requires nine data IC's 116, each of which has 642 data output channels.

Accordingly, the LCD according to the first embodiment of the present invention sets the number of output channels of the data IC's 116 into any one of 600 channels, 618 channels, 630 channels and 642 channels in response to the first and second channel selection signals P1 and P2, thereby expressing all resolutions of the liquid crystal display panel 102. In other words, the data IC 116 of the LCD according to the first embodiment of the present invention may be made to have 642 data output channels and the number of active output channels of the data IC's 116 set in response to the first and second channel selection signals P1 and P2 from the first and second option pins OP1 and OP2, for example, so that it can be compatibly used for all resolution of the liquid crystal display panel 102.

Figure 5:
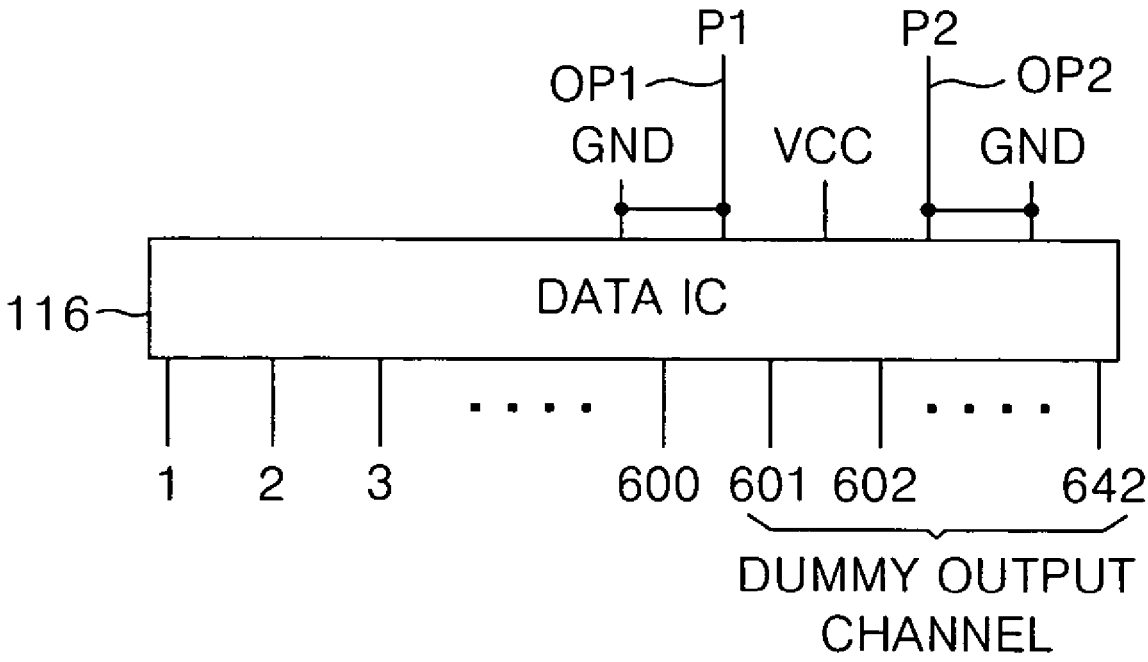
FIG. 5 illustrates a data integrated circuit set to have 600 data output channels in accordance with first and second output selection signals illustrated in FIG. 4.

More specifically, the data IC 116 of the LCD according to the first embodiment of the present invention is manufactured to have 642 data output channels. When a value of the first and second channel selection signals P1 and P2 applied to the data IC 116 is '00' by connecting each of the first and second option pins OP1 and OP2 to the ground voltage source GND, the data IC 116 outputs pixel voltage signals via the 1st to 600th data output channels from 642 data output channels available as illustrated in FIG. 5. In particular, the 601st to 642nd output channels become dummy output channels.

Figure 6:
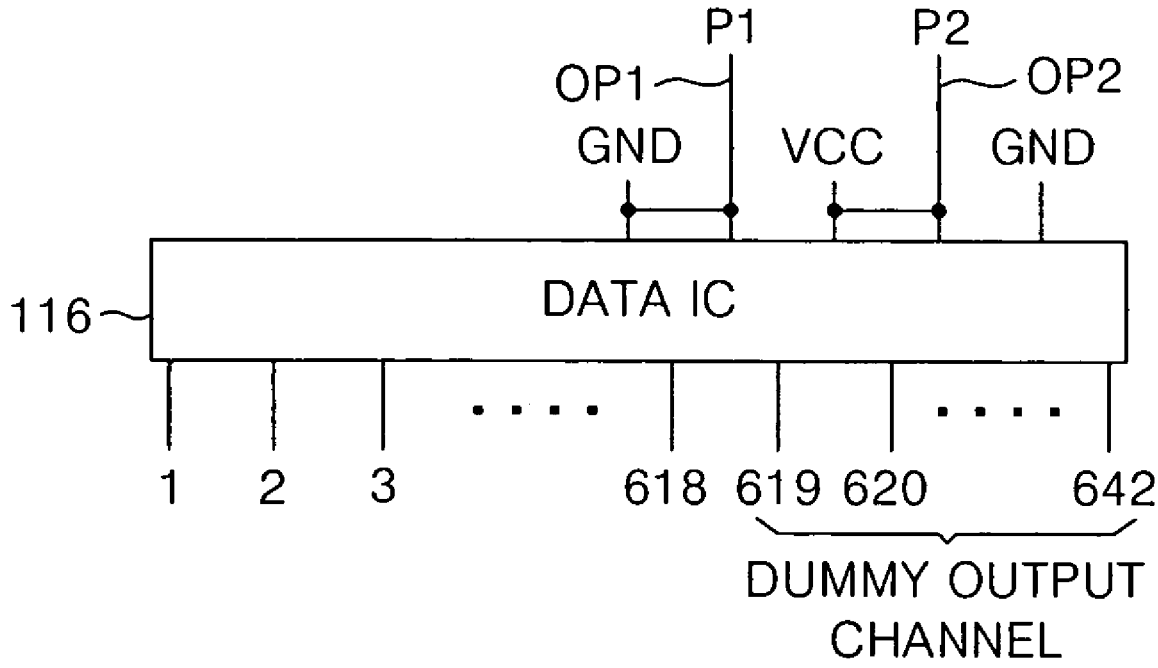
FIG. 6 illustrates a data integrated circuit set to have 618 data output channels in accordance with first and second output selection signals illustrated in FIG. 4.

When a value of the first and second channel selection signals P1 and P2 applied to the data IC 116 is '01' by connecting the first option pin OP1 to the ground voltage source GND and the second option pin OP2 to the voltage source VCC, the data IC 116 outputs pixel voltage signals via the 1st to 618th data output channels of 642 data output channels as illustrated in FIG. 6. In this case, the 619th to 642nd output channels become dummy output channels.

Figure 7:
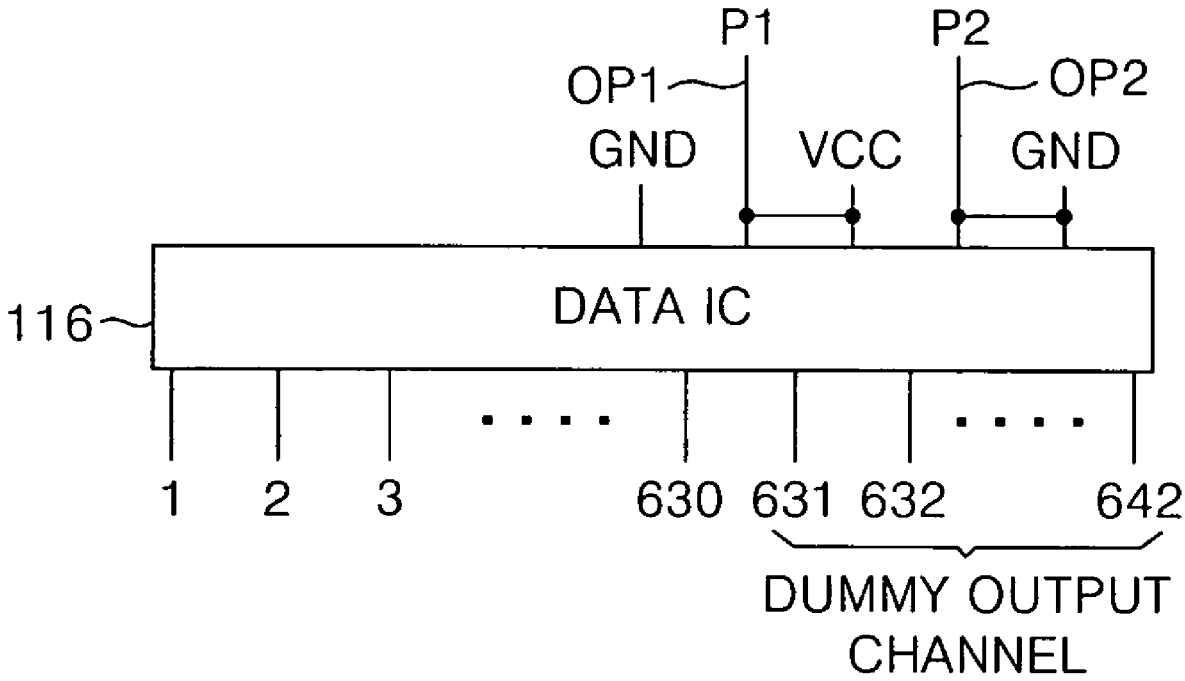
FIG. 7 illustrates a data integrated circuit set to have 630 data output channels in accordance with first and second output selection signals illustrated in FIG. 4.
Figure 8:
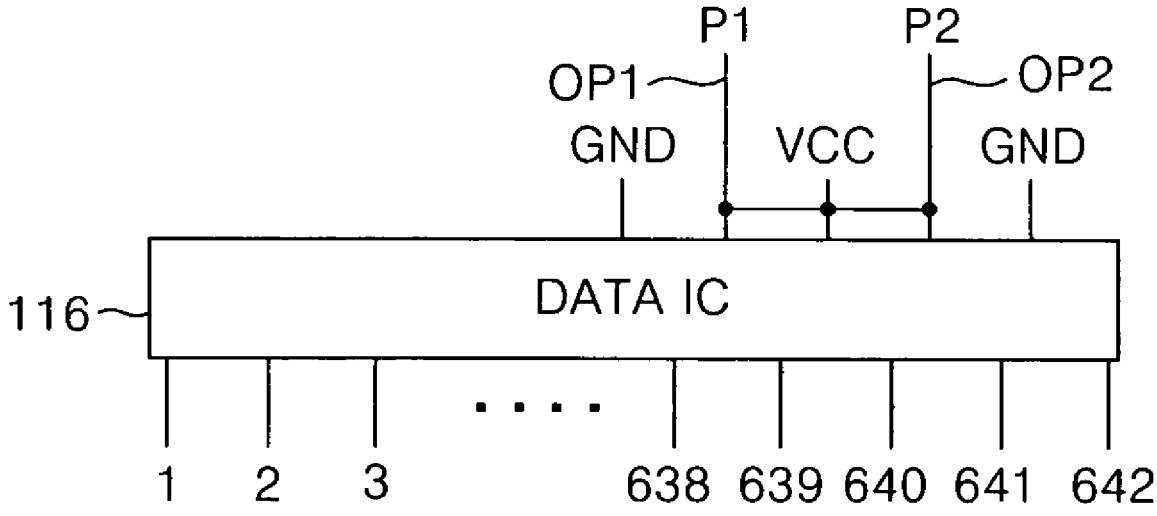
FIG. 8 illustrates a data integrated circuit set to have 642 data output channels in accordance with first and second output selection signals illustrated in FIG. 4.

When a value of the first and second channel selection signals P1 and P2 applied to the data IC 116 is '10' by connecting the first option pin OP1 to the voltage source VCC and the second option pin OP2 to the ground voltage source GND, the data IC 116 only outputs pixel voltage signals via the 1st to 630th data output channels of 642 data output channels as illustrated in FIG. 7. In particular, the 631st to 642nd output channels become dummy output channels. Finally, when a value of the first and second channel selection signals P1 and P2 applied to the data IC 116 is '11' by connecting each of the first and second option pins OP1 and OP2 are connected to the voltage source VCC, the data IC 116 outputs pixel voltage signals via the 1st to 642nd data output channels as illustrated in FIG. 8.

Figure 9:
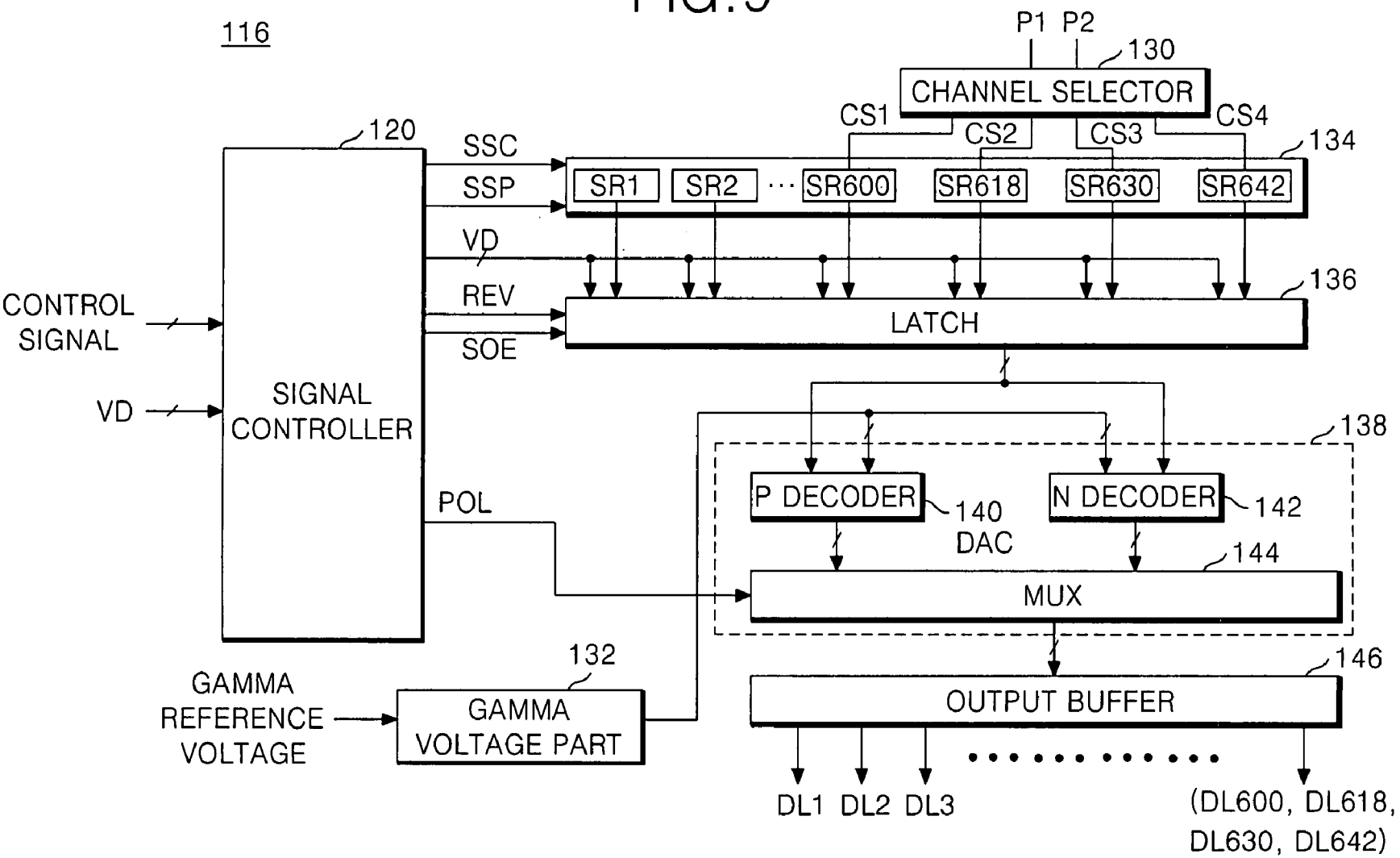
FIG. 9 is a block diagram illustrating an internal configuration of the data integrated circuit in FIG. 4.

Accordingly, as illustrated in FIG. 9, the data IC 116 of the LCD according to the first embodiment of the present invention includes a channel selector 130 for setting an output channel of the data IC 116 in response to the first and second channel selection signals P1 and P2 applied to the first and second option pins OP1 and OP2, for example, a shift register part 130 for applying sequential sampling signals, a latch part 134 for sequentially latching the pixel data VD in response to the sampling signals to output them simultaneously, a digital-to-analog converter (DAC) 138 for converting the pixel data VD from the latch part 136 into pixel voltage signals, and an output buffer part 146 for buffering pixel voltage signals from the DAC 138 to output them.

Further, the data IC 116 includes a signal controller 120 for interfacing with various control signals from the timing controller 108 and the pixel data VD, and a gamma voltage part 132 for supplying positive and negative gamma voltages required for the DAC 138.

The signal controller 120 controls various control signals (i.e., SSP, SSC, SOE, REV and POL, etc.) from the timing controller 108 and the pixel data VD so as to output them to the corresponding elements.

The gamma voltage part 132 sub-divides a plurality of gamma reference voltages inputted from a gamma reference voltage generator (not illustrated) for each gray level.

The channel selector 130 applies first to fourth channel control signals CS1 to CS3, via the first and second option pins OP1 and OP2, to the shift register part 134 in response to the first and second channel selection signals P1 and P2. In other words, the channel selector 130 generates the first channel selection signal CS1 corresponding to the first and second channel selection signals P1 and P2 having a value of '00', the second channel selection signal CS2 corresponding to the first and second channel selection signals P1 and P2 having a value of '01', the third channel selection signal CS3 corresponding to the first and second channel selection signals P1 and P2 having a value of '10', and the fourth channel selection signal CS4 corresponding to the first and second channel selection signals P1 and P2 having a value of '11'.

Shift registers included in the shift register part 134 sequentially shift a source start pulse SSP from the signal controller 120 in response to a source sampling clock signal SSC and outputs sampling signals. In this example, the shift register part 134 consists of 642 shift registers SR1 to SR642.

Such a shift register part 134 applies output signals of the 600th, 618th, 630th and 642nd shift registers SR600, SR628, SR630 and SR642 to the next stage data IC 116 in response to the first to fourth channel control signals CS1 to CS4 from the channel selector 130.

For example, when the first output control signal CS1 is applied from the channel selector 130, the shift register part 134 sequentially shifts a source start pulse SSP from the signal controller 120 in response to a source sampling clock signal SSC using the 1st to 600th shift registers SR1 to SR600, and outputs them as sampling signals. In particular, an output signal (i.e., a carry signal) of the 600th shift register SR600 is applied to the 1st shift register SR1 of the next stage data IC 116 (for a daisy chain connection). Thus, the 601st to 642nd shift registers SR601 to SR642 do not output sampling signals. Herein, if the shift registers are driven in a bilateral direction, then it becomes possible to use more advantageously them by making a dummy treatment without employing 42 middle channels.

When the second output control signal CS2 is applied from the channel selector 130, the shift register part 134 sequentially shifts a source start pulse SSP from the signal controller 120 in response to a source sampling clock signal SSC using the 1st to 618th shift registers SR1 to SR618, and outputs them as sampling signals. In particular, an output signal (i.e., a carry signal) of the 618th shift register SR618 is applied to the 1st shift register SR1 of the next stage data IC 116. Thus, the 619th to 642nd shift registers SR619 to SR642 do not output sampling signals.

When the third output control signal CS3 is applied from the channel selector 130, the shift register part 134 sequentially shifts a source start pulse SSP from the signal controller 120 in response to a source sampling clock signal SSC using the 1st to 630th shift registers SR1 to SR630, and outputs them as sampling signals. In particular, an output signal (i.e., a carry signal) of the 630th shift register SR630 is applied to the 1st shift register SR1 of the next stage data IC 116. Thus, the 631st to 642nd shift registers SR601 to SR642 do not output sampling signals. Herein, if the shift registers are driven in a bilateral direction, then it becomes possible to use more advantageously them by making a dummy treatment without employing 12 middle channels.

When the fourth output control signal CS4 is applied from the channel selector 130, the shift register part 134 sequentially shifts a source start pulse SSP from the signal controller 120 in response to a source sampling clock signal SSC using the 1st to. 642nd shift registers SR1 to SR642, and outputs them as sampling signals. In particular, an output signal (i.e., a carry signal) of the 642nd shift register SR642 is applied to the 1st shift register SR1 of the next stage data IC 116.

The latch part 136 sequentially samples the pixel data VD from the signal controller 120 for a certain unit in response to the sampling signals from the shift register part 134 to latch them. To achieve this, the latch part 136 is comprised of at most 642 latches so as to latch 642 pixel data VD, and each of the latches has a dimension corresponding to the number of bits of the pixel data VD. Particularly, the timing controller 108 divides the pixel data VD into even pixel data VDeven and odd pixel data VDodd so as to reduce a transmission frequency, and simultaneously outputs them through each transmission line. Herein, each of the even pixel data VDeven and the odd pixel data VDodd includes red(R), green(G) and blue(B) pixel data.

Thus, the latch part 136 simultaneously latches the even pixel data VDeven and the odd pixel data VDodd supplied via the signal controller 120 for each sampling signal. Then, the latch part 136 simultaneously outputs the pixel data VD through the selected number of output channels (600, 618, 630 or 642 data output channels) in response to a source output enable signal SOE from the signal controller 120. In particular, the latch part 136 restores pixel data VD which have been modulated such that the transition bit number is reduced in response to a data inversion selection signal REV. The timing controller 8 modulates the pixel data VD such that the number of transition bits are minimized using a reference value due to determine whether the bits should be inverted or not. This minimizes an electromagnetic interference (EMI) upon data transmission due to a minimal number of bit transitions from LOW to HIGH or HIGH to LOW.

The DAC 138 simultaneously converts the pixel data VD from the latch part 136 into positive and negative pixel voltage signals and outputs them. To achieve this, the DAC 138 includes a positive (P) decoding part 140 and a negative (N) decoding part 142 commonly connected to the latch part 136, and a multiplexer (MUX) part 144 for selecting output signals of the P decoding part 140 and the N decoding part 142.

A number n of P decoders included in the P decoding part 140 convert n pixel data inputted simultaneously from the latch part 136 into positive pixel voltage signals using positive gamma voltages from the gamma voltage part 132. A number i of N decoders included in the N decoding part 142 convert i pixel data inputted simultaneously from the latch part 136 into negative pixel voltage signals using negative gamma voltages from the gamma voltage part 132. In this example, at most 642 multiplexers included in the multiplexer part 144 selectively outputs the positive pixel voltage signals from the P decoder 140 or the negative pixel voltage signals from the N decoder 142 in response to a polarity control signal POL from the signal controller 120.

At most 642 output buffers included in the output buffer part 146 are comprised of voltage followers, etc. connected, in series, to the respective 642 data lines DL1 to DL642. Such output buffers buffer pixel voltage signals from the DAC 138 to apply them to the data lines DL1 to DL642.

In the LCD according to the first embodiment of the present invention, the data IC 116 having 600 data output channels is used for the liquid crystal display panel 102 having SXGA+ resolution or UXGA resolution; the data IC 116 having 618 data output channels is used for the liquid crystal display panel 102 having XGA or WSXGA resolution; the data IC 116 having 630 data output channels is used for the liquid crystal display panel 102 having WSXGA resolution; and the data IC 116 having 642 data output channels is used for the liquid crystal display panel 102 having WXGA or WUXGA resolution WXGA or WUXGA as indicated in the above Table 1.

Figure 10:
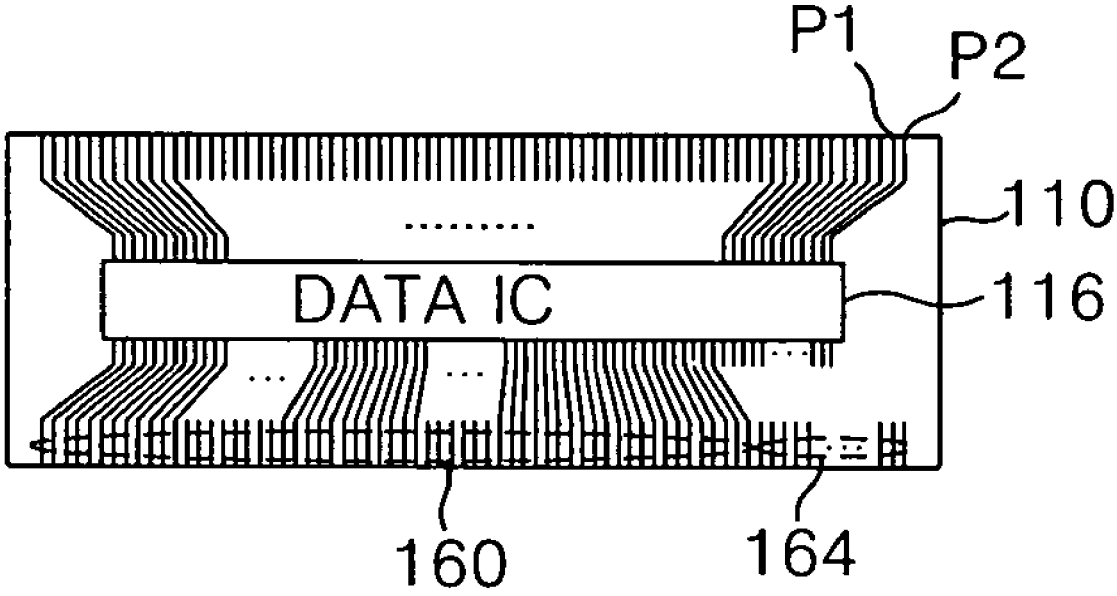
FIG. 10 illustrates the data tape carrier package illustrated in FIG. 4.

The data IC 116 of the LCD according to a first embodiment of the present invention is mounted in the data TCP 110 as illustrated in FIG. 10.

The data TCP 110 is provided with input pads connected to a data printed circuit board (not illustrated) and a data output pad group 160 and a dummy data output pad group 164 connected to the liquid crystal display panel 102. In particular, a sum of the pad number of the data output pad group 160 provided at the data TCP 110 with the pad number of the dummy data output pad group 164 becomes equal to the output channel number of the data IC 116.

The data output pad group 160 is connected, via a signal wiring provided at the data TCP 110, to the data output channel group of the data IC 116. The pad number of the data output pad group 160 is equal to the output channel number of the data IC 116 selected by the first and second channel selection signals P1 and P2. For instance, if the output channels of the data IC 116 are selected as 600 data output channels of 642 data output channels by the first and second channel selection signals P1 and P2 as mentioned above, then the data output pad group 160 of the data TCP 110 also has 600 output pads.

The dummy data output pad group 164 becomes equal to output channels of the remaining data IC 116 excluding the output channels of the data IC 116 selected by the first and second channel selection signals P1 and P2. For instance, if the output channels of the data IC 116 are selected into 600 data output channels of 642 data output channels by the first and second channel selection signals P1 and P2 as mentioned above, then the dummy data output pad group 164 of the data TCP 110 has 42 dummy output pads.

Figure 11:
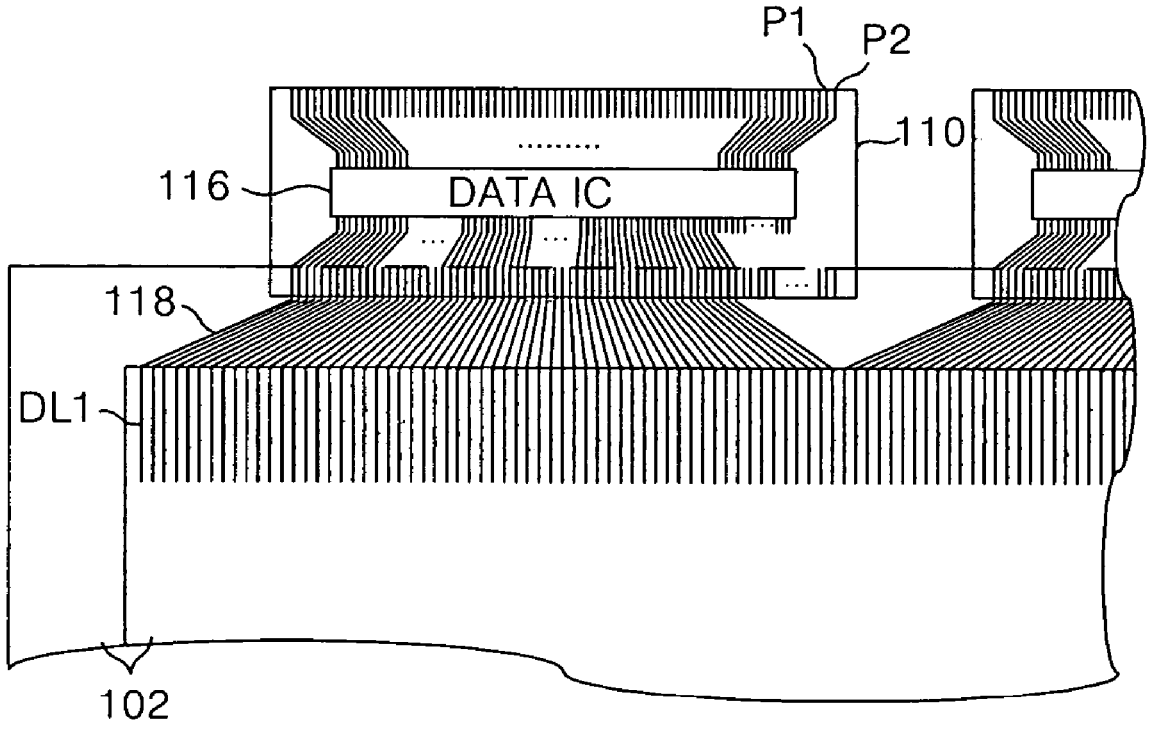
FIG. 11 illustrates the data tape carrier package attached onto the liquid crystal display panel illustrated in FIG. 4.

Such a data TCP 110 is attached to a data pad part 186 provided on the lower substrate of the liquid crystal display panel 102 illustrated in FIG. 11.

Figure 12:
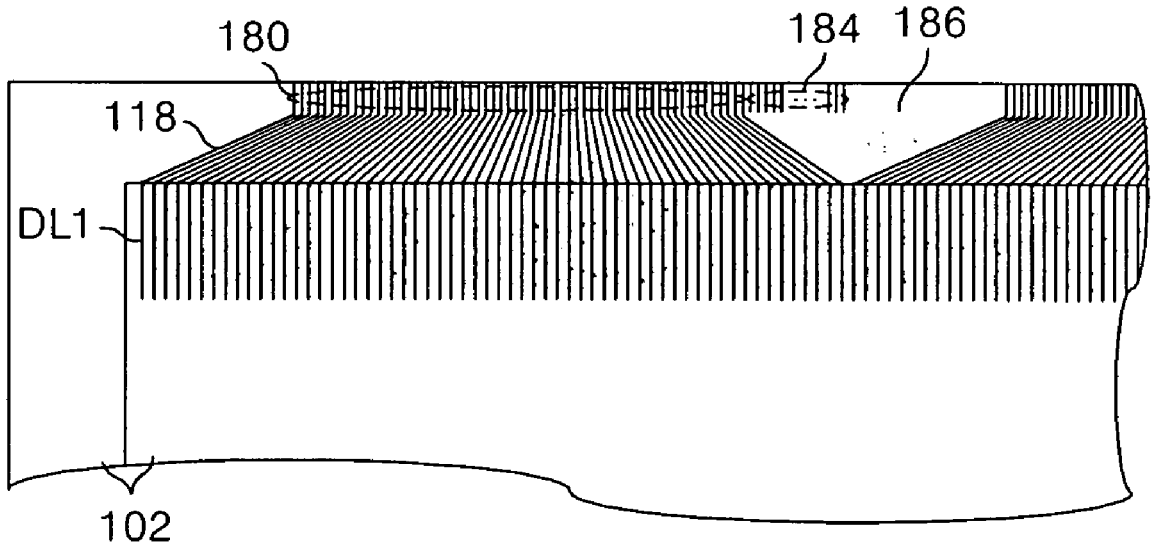
FIG. 12 illustrates the data pad part of the liquid crystal display panel illustrated in FIG. 11.

The data pad part 186 is provided with a data input pad group 180 to which the data output pad group 160 of the data TCP 110 is attached and a dummy data input pad group 184 to which the dummy data output pad group 164 of the data TCP 110 is attached as illustrated in FIG. 12.

The number of pads in the data input pad group 180 becomes equal to that of the data output pad group 160 of the data TCP 110. Each pad of the data input pad group 180 is connected, via a link 118, to the data lines DL.

In an LCD according to the first embodiment of the present invention, the data output pad group 160 of the data TCP 110 and the data input pad group 180 of the liquid crystal display panel 102 are designed equally in such a manner to correspond to the output channels of the data IC 116 varied in response to the first and second output selection signals P1 and P2 as mentioned above.

As described above, the LCD according to the first embodiment of the present invention sets the output channels of the data IC 116 in accordance with a resolution of the liquid crystal display panel 102 as indicated in the above Table 1 in response to the first and second channel selection signals P1 and P2 applied to the first and second option pins OP1 and OP2, thereby configuring multiple resolutions using only one type data IC 116. Accordingly, the LCD according to the first embodiment of the present invention is capable of improving working efficiency as well as reducing a manufacturing cost.

Figure 13:
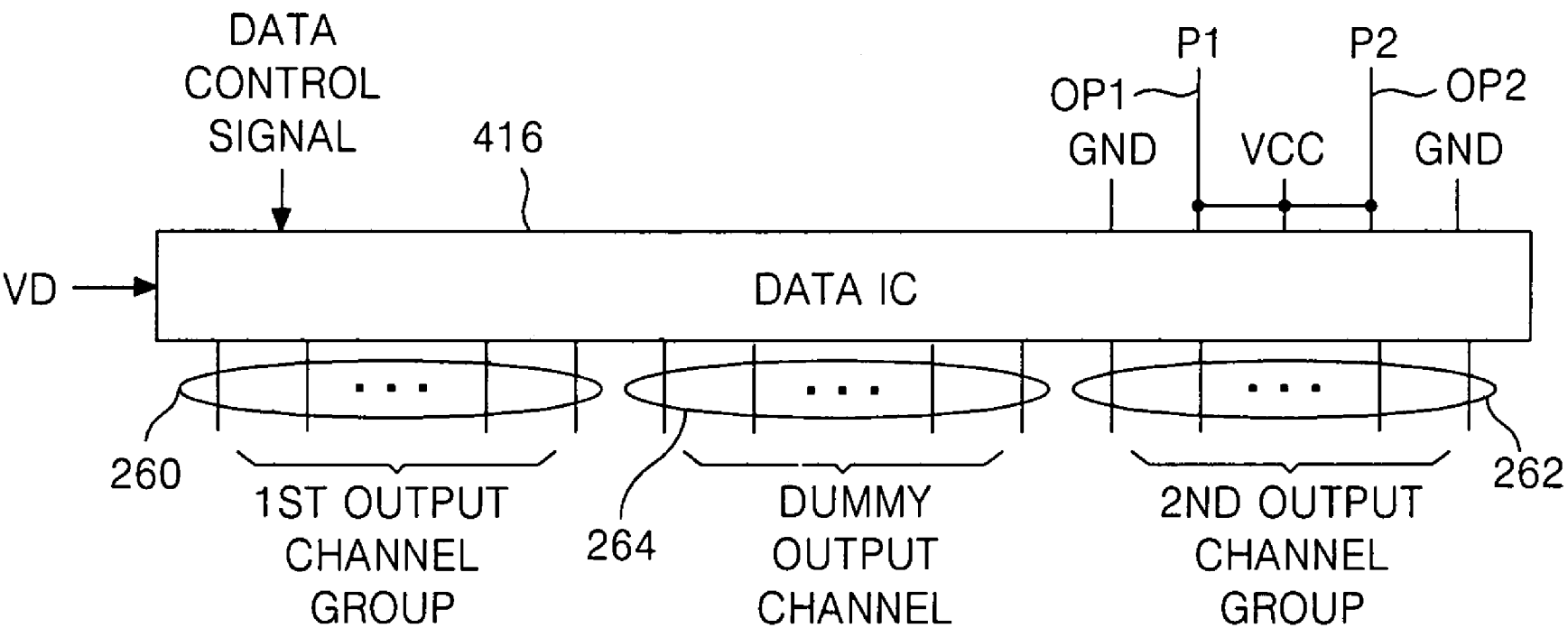
FIG. 13 illustrates a data integrated circuit of a liquid crystal display according to a second embodiment of the present invention.

FIG. 13 is a block diagram illustrating a configuration of a data IC in a liquid crystal display according to a second embodiment of the present invention.

Referring to FIG. 13, the LCD according to the second embodiment of the present invention has the same elements as the LCD according to the first embodiment of the present invention except for a data IC 416. Therefore, in the LCD according to the second embodiment of the present invention, the data IC 416 only will be described in conjunction with FIG. 13 and FIG. 4, but an explanation as to other elements will be omitted. Herein, a reference numeral "116" of the data IC illustrated in FIG. 4 will be replaced by a reference numeral "416" illustrated in FIG. 13.

In the LCD according to the second embodiment of the present invention, the data IC 416 includes a first data output channel group 260 and a second data output channel group 262 for always applying a data to the data lines DL1 to DLm, and a dummy output channel group 264 provided between the first and second data output channel groups 260 and 262.

Such a data IC 416 includes first and second option pins OP1 and OP2 supplied with first and second channel selection signals P1 and P2 for determining whether or not pixel data that is applied, via a dummy data output channel group 264, to the data lines DL1 to DLm in accordance with the number of the data lines DL1 to DLm is outputted.

Each of the first and second option pins OP1 and OP2 is selectively connected to a voltage source VCC and a ground voltage source GND to have a 2-bit binary logical value. Thus, the first and second channel selection signals P1 and P2 applied, via the first and second option pins OP1 and OP2, to the data IC 416 have values of '00', '01', '10' and '11'.

Accordingly, each of the data IC's 416 has output channels set in advance depending upon a resolution of the liquid crystal display panel 102 in response to the first and second channel selection signals P1 and P2 applied via the first and second option pins OP1 and OP2.

The number of data IC's 416 according to output channels of the data IC's 416 depending upon a resolution of the liquid crystal display panel 102 is as indicated in the above Table 1.

Accordingly, the LCD according to the second embodiment of the present invention sets output channels of the data IC's 416 into any one of 600 channels, 618 channels, 630 channels and 642 channels in response to the first and second channel selection signals P1 and P2, thereby expressing all resolutions of the liquid crystal display panel 102. In other words, the data IC 416 of the LCD according to the second embodiment of the present invention is made to have 642 data output channels, and output channels of the data IC's 416 are set in response to the first and second channel selection signals P1 and P2 from the first and second option pins OP1 and OP2, so that it can be compatibly used for all resolution types of the liquid crystal display panel 102. Further, the LCD according to the second embodiment of the present invention arranges the dummy data output channel group 264 of the data IC 416 according to a determination of the output channel at the middle portion of data output channels of the data IC 416. In other words, first and second data output channel groups 260 and 262 of the data IC 416 have the same output channels with having the dummy data output channel group 264 therebetween. Thus, the LCD according to the second embodiment of the present invention equalizes output channels of each of the first and second data output channel groups 260 and 262 of the data IC 416, thereby reducing an electromagnetic interference upon output of the pixel data.

More specifically, the data IC 416 of the LCD according to the second embodiment of the present invention is manufactured to have 642 data output channels.

Figure 14:
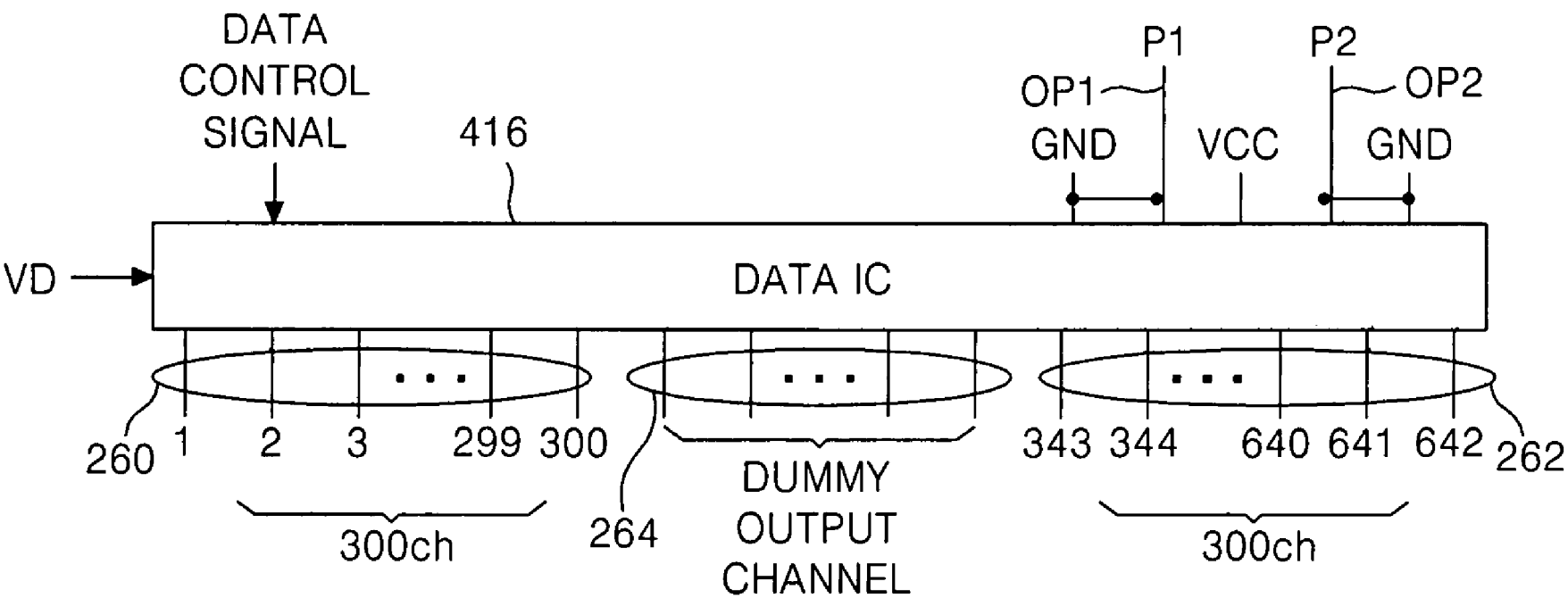
FIG. 14 illustrates a data integrated circuit set to have 600 data output channels in accordance with first and second output selection signals illustrated in FIG. 13.

When a value of the first and second channel selection signals P1 and P2 applied to the data IC 416 is '00' by connecting each of the first and second option pins OP1 and OP2 to the ground voltage source GND, the data IC 416 outputs pixel data 416 outputs pixel data via the first data output channel group 260 having the 1st to 300th output channels of 642 data output channels and the second data output channel group 262 having the 343rd to 642nd output channels as illustrated in FIG. 14. In particular, the dummy data output channel group 264 includes the 301st to 342nd output channels which are treated as dummy lines.

Figure 15:
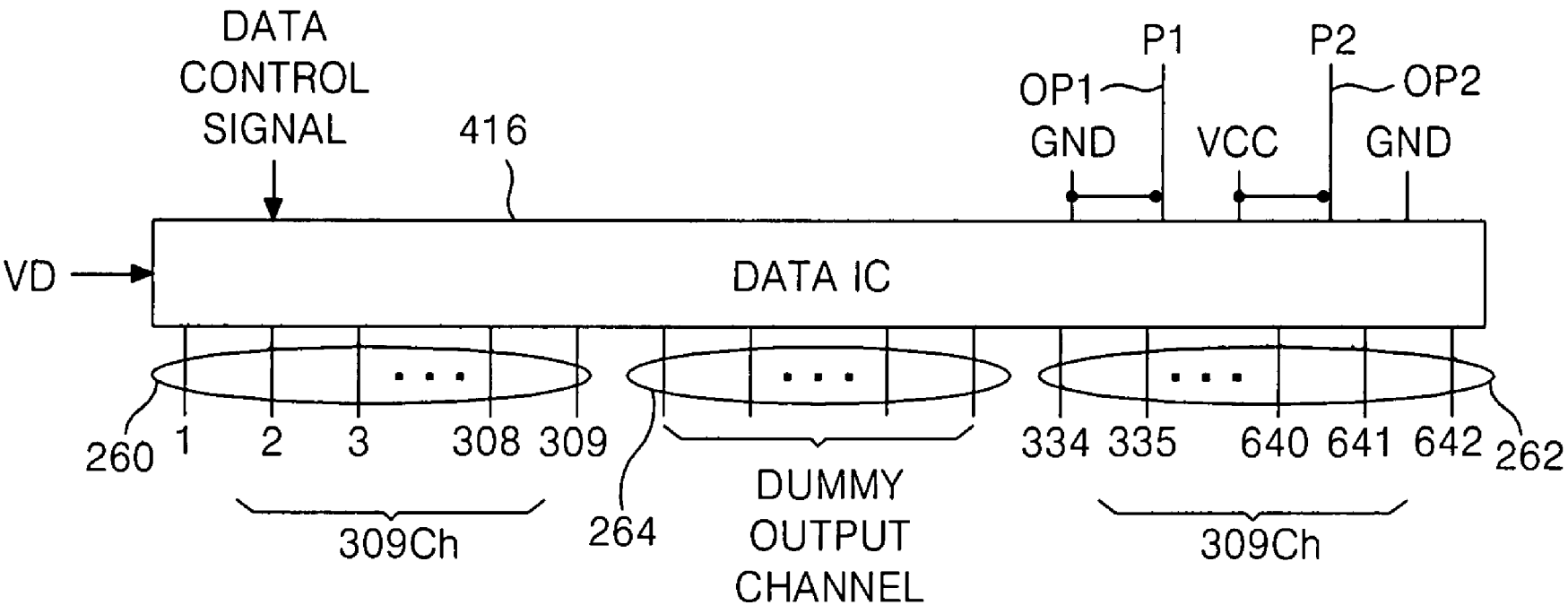
FIG. 15 illustrates a data integrated circuit set to have 618 data output channels in accordance with first and second output selection signals illustrated in FIG. 13.

When a value of the first and second channel selection signals P1 and P2 applied to the data IC 416 is '01' by connecting the first option pin OP1 to the ground voltage source GND and the second option pin OP2 to the voltage source VCC, the data IC 416 outputs pixel data via the first data output channel group 260 having the 1st to 309th output channels of 642 data output channels and the second data output channel group 262 having the 334th to 642nd output channels as illustrated in FIG. 15. In particular, the dummy data output channel group 264 includes the 310th to 333rd output channels which are treated as dummy lines.

Figure 16:
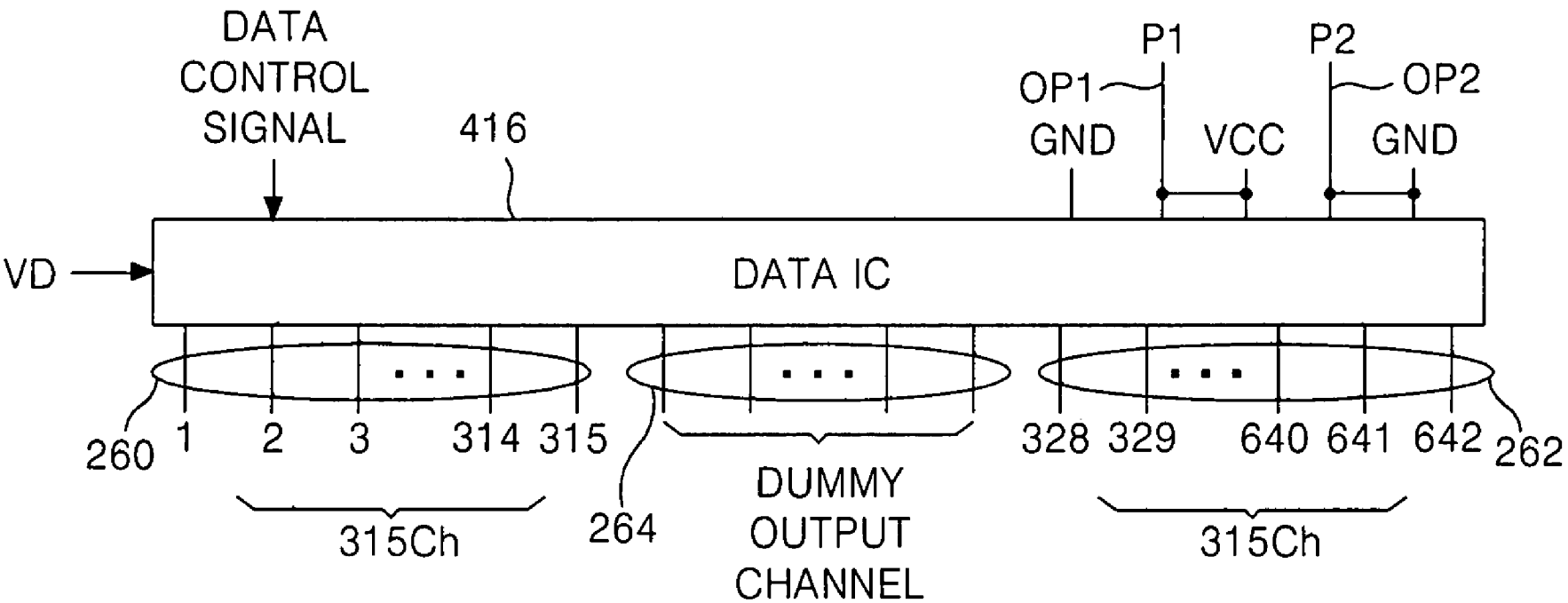
FIG. 16 illustrates a data integrated circuit set to have 630 data output channels in accordance with first and second output selection signals illustrated in FIG. 13.

When a value of the first and second channel selection signals P1 and P2 applied to the data IC 416 is '10', by connecting the first option pin OP1 to the voltage source VCC and the second option pin OP2 to the ground voltage source GND, the data IC 416 outputs pixel data via the first data output channel group 260 including the 1st to 315th output channels of 642 data output channels and the second data output channel group 262 including the 328th to 642nd output channels as illustrated in FIG. 16. In particular, the dummy data output channel group 264 includes the 316th to 327th output channels as dummy lines.

Figure 17:
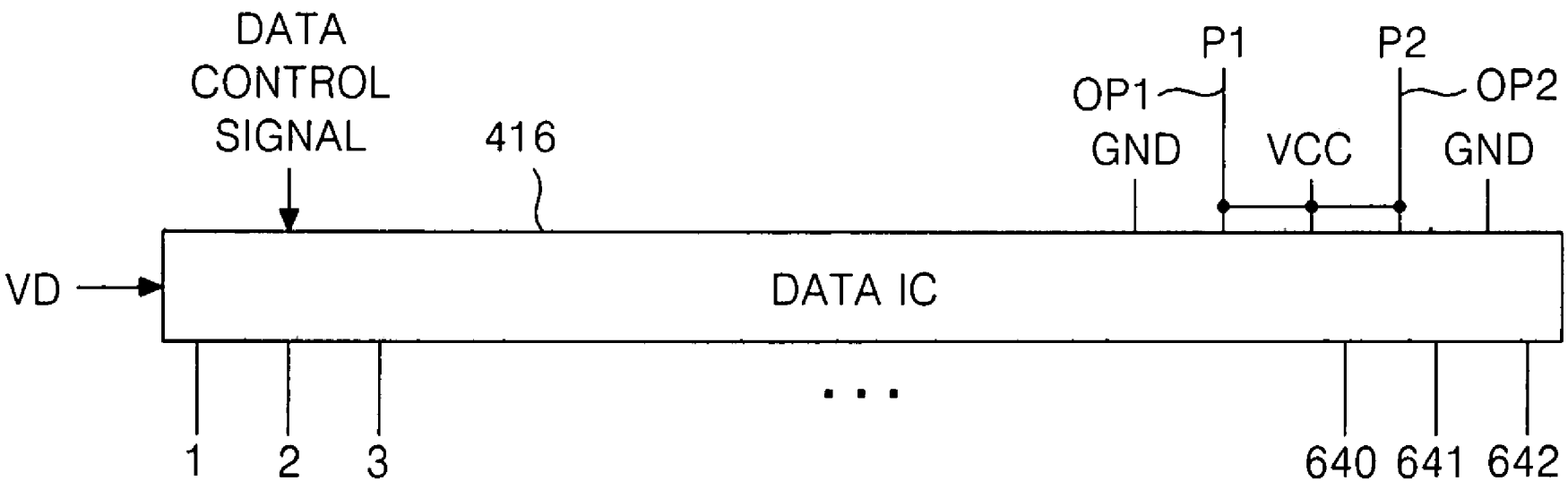
FIG. 17 illustrates a data integrated circuit set to have 642 data output channels in accordance with first and second output selection signals illustrated in FIG. 13.

Finally, when a value of the first and second channel selection signals P1 and P2 applied to the data IC 416 is '11' by connecting each of the first and second option pins OP1 and OP2 to the voltage source VCC, the data IC 416 outputs pixel data via the first data output channel group 260, the dummy data output channel group 264 and the second output channel group 262, that is, via the 1st to 642nd data output channels as illustrated in FIG. 17.

Figure 18:
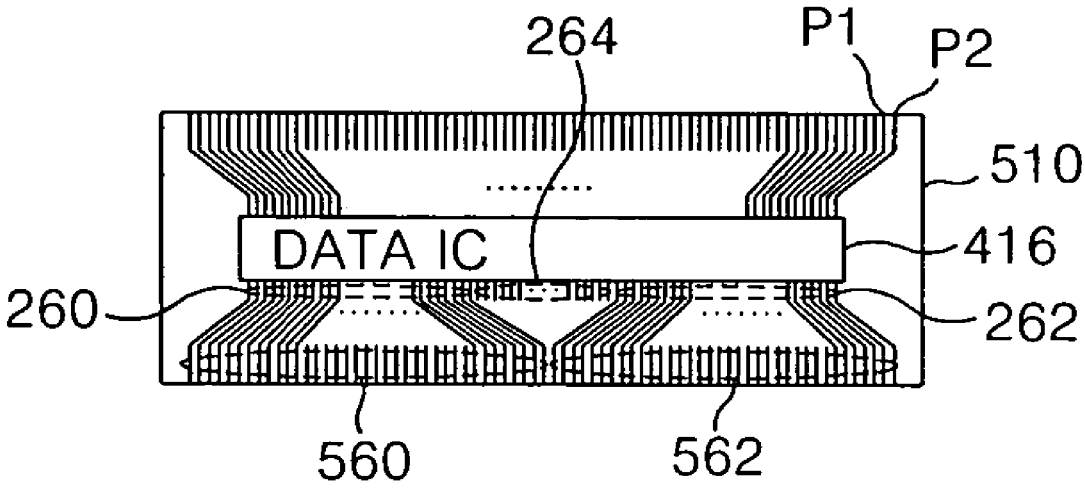
FIG. 18 illustrates a data tape carrier package mounted with the data integrated circuit of the liquid crystal display according to the second embodiment of the present invention illustrated in FIG. 13.

Meanwhile, the data IC 416 of the LCD according to the second embodiment of the present invention is mounted in a data TCP 510 as illustrated in FIG. 18.

The data TCP 510 is provided with input pads connected to a data printed circuit board (not illustrated) and a first data output pad group 560 and a second data output pad group 562 connected to the liquid crystal display panel 102. In particular, the dummy data output pad group 264 of the data IC 416 mounted in the data TCP 510 is subject to a dummy treatment. In other words, the dummy data output channel group 264 of the data IC 416 is not connected to the first and second data output pads 560 and 562.

The first data output pad group 560 is connected, via a signal wiring provided at the data TCP 510, to the first data output channel group 260 of the data IC 416. The pad number of the first data output pad group 560 becomes equal to the channel number of the first data output channel group 260 of the data IC 416 selected by the first and second channel selection signals P1 and P2. For instance, if the output channels of the data IC 416 are selected into 600 data output channels of 642 data output channels by the first and second channel selection signals P1 and P2 as mentioned above, then the first data output pad group 560 of the data TCP 510 also has the 1st to 300th output pads.

The second data output pad group 562 is connected, via a signal wiring provided at the data TCP 510, to the second data output channel group 262 of the data IC 416. The pad number of the second data output pad group 562 becomes equal to the channel number of the second data output channel group 262 of the data IC 416 selected by the first and second channel selection signals P1 and P2. For instance, if the output channels of the data IC 416 are selected into 600 data output channels of 642 data output channels by the first and second channel selection signals P1 and P2 as mentioned above, then the second data output pad group 562 of the data TCP 510 also has the 300th to 600th output pads.

Figure 19:
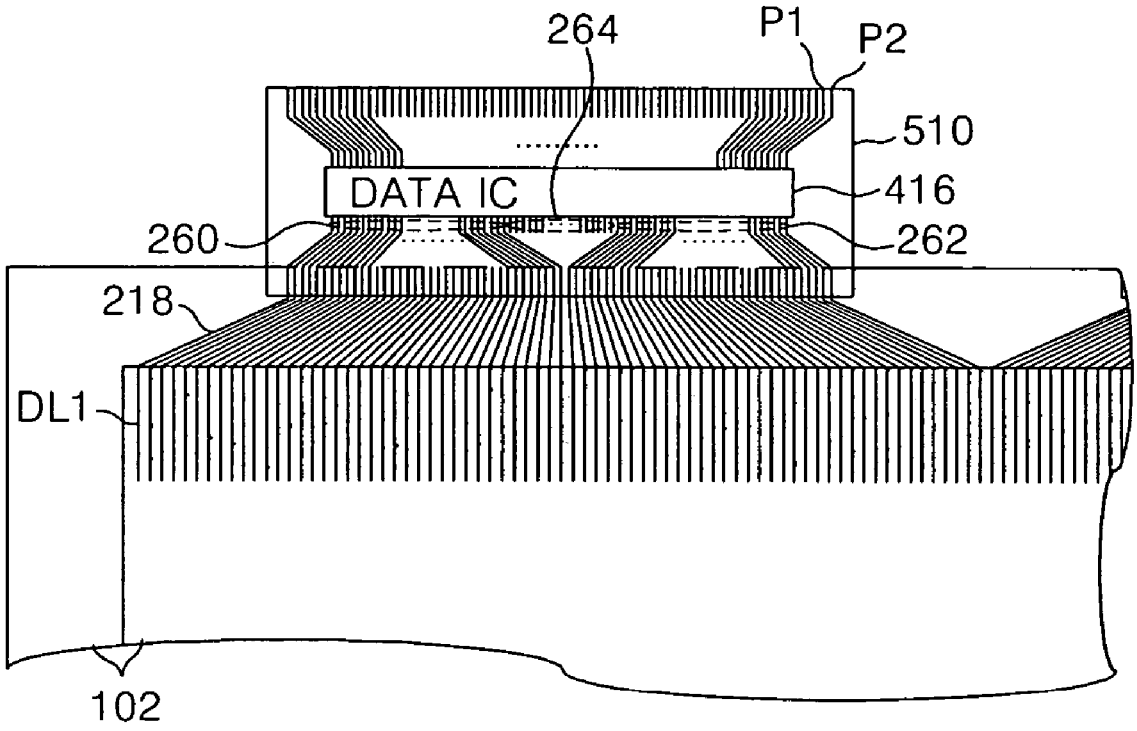
FIG. 19 illustrates a liquid crystal display panel onto which the data tape carrier package illustrated in FIG. 13 is attached.

Such a data TCP 510 is attached to a data pad part 586 provided on the lower substrate of the liquid crystal display panel 102 illustrated in FIG. 19.

Figure 20:
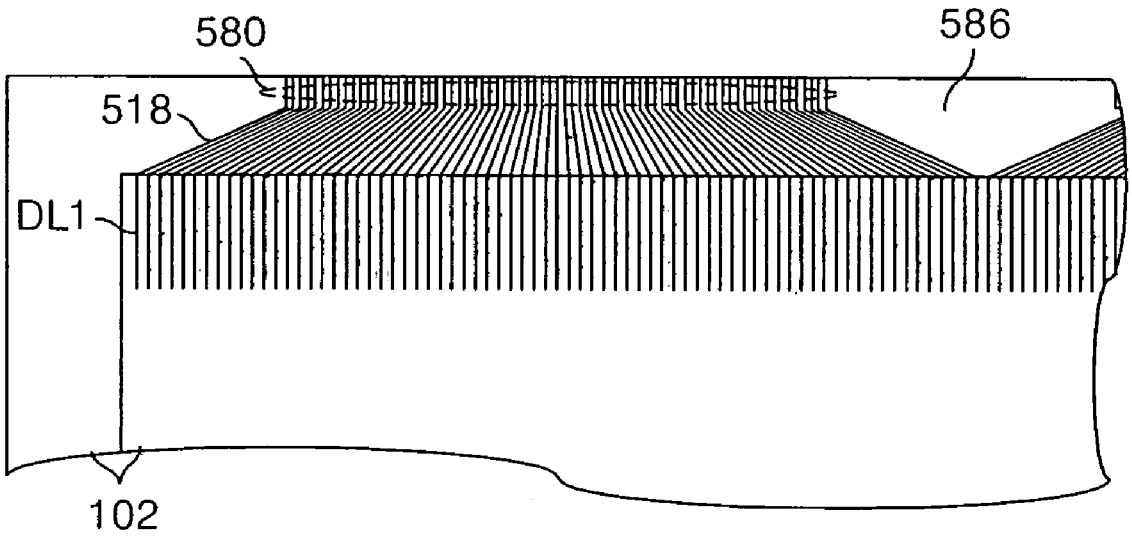
FIG. 20 illustrates the data pad part of the liquid crystal display panel illustrated in FIG. 19.

The data pad part 586 is provided with a data input pad group 580 to which the first data output pad group 560 and the second data output pad group 562 of the data TCP 510 is attached as illustrated in FIG. 20.

The pad number of the data input pad group 580 becomes equal to that of the first and second data output pad groups 560 and 562 of the data TCP 510. Each pad of the data input pad group 580 is connected, via a link 518, to the data lines DL.

In such an LCD according to the second embodiment of the present invention, the first and second data output pad groups 560 and 562 of the data TCP 510 and the data input pad group 580 of the liquid crystal display panel 102 are designed equally in such a manner to correspond to the output channels of the data IC 416 varied in response to the first and second output selection signals P1 and P2 as mentioned above.

As described above, the LCD according to the second embodiment of the present invention sets the output channels of the data IC 416 in accordance with a resolution of the liquid crystal display panel 102 in response to the first and second channel selection signals P1 and P2 applied to the first and second option pins OP1 and OP2, as indicated in the above Table 1. This way, all resolutions may be displayed based only on the data IC 416. Accordingly, the LCD according to the second embodiment of the present invention is capable of improving operating efficiency as well as reducing the manufacturing cost.

Figure 21:
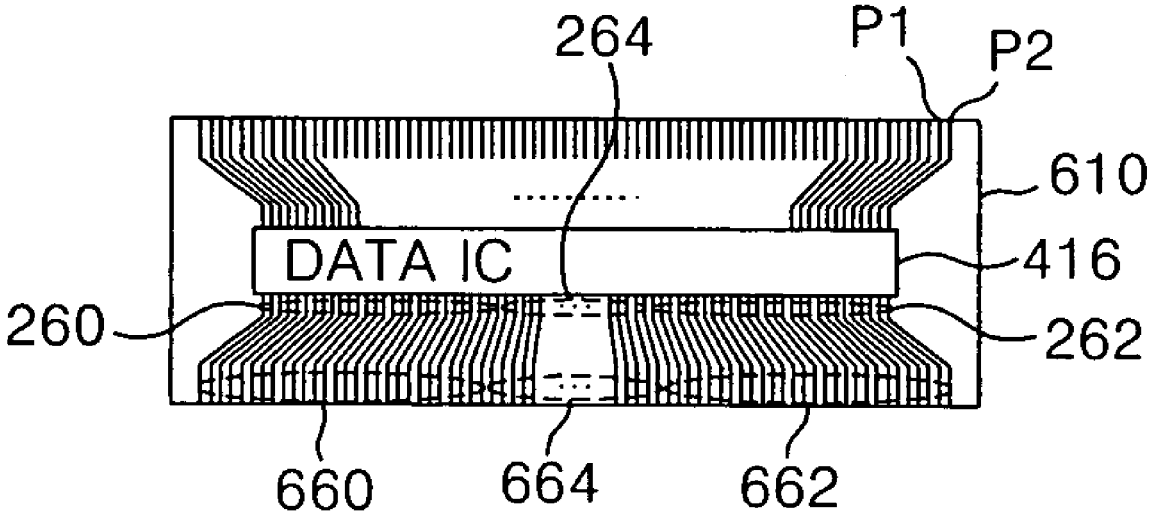
FIG. 21 illustrates a differently-shaped data tape carrier package mounted with the data integrated circuit of the liquid crystal display according to the second embodiment of the present invention illustrated in FIG. 13.

Alternatively, the data IC 416 of the LCD according to the second embodiment of the present invention is mounted in a data TCP 610 as illustrated in FIG. 21.

The data TCP 610 is provided with input pads connected to a data printed circuit board (not illustrated), a first data output pad group 660 and a second data output pad group 662 connected to the liquid crystal display panel 102, and a dummy data output pad group 664 provided between the first and second data output pad groups 660 and 662. In particular, the number of data output pads provided at the data TCP 610 becomes equal to that of output channels of the data IC 416.

The first data output pad group 660 is connected, via a signal wiring provided at the data TCP 610, to the first data output channel group 260 of the data IC 416. The number of pads of the first data output pad group 660 becomes equal to the number of channels of the first data output channel group 260 of the data IC 416 selected by the first and second channel selection signals P1 and P2. For example, if the output channels of the data IC 416 are determined to be 600 data output channels out of 642 data output channels by the first and second channel selection signals P1 and P2 as mentioned above, then the first data output pad group 660 of the data TCP 610 also has 300 output pads (i.e., the 1st to 300th output pads).

The second data output pad group 662 is connected, via a signal wiring provided at the data TCP 610, to the second data output channel group 262 of the data IC 416. The number of pads of the second data output pad group 662 becomes equal to the number of channels of the second data output channel group 262 of the data IC 416 selected by the first and second channel selection signals P1 and P2. For instance, if the output channels of the data IC 416 are selected into 600 data output channels of 642 data output channels by the first and second channel selection signals P1 and P2 as mentioned above, then the second data output pad group 662 of the data TCP 610 also has 300 output pads (i.e., the 300th to 600th output pads).

The dummy output pad group 664 is provided between the first and second data output pad groups 660 and 662, and is connected, via a signal wiring provided at the data TCP 610, to the dummy data output channel group 264 of the data IC 416. The number of pads of the dummy data output pad group 664 becomes equal to the number of channels of the dummy data output channel group 264 of the data IC 416 selected by the first and second channel selection signals P1 and P2. For instance, if the output channels of the data IC 416 are selected into 600 data output channels of 642 data output channels by the first and second channel selection signals P1 and P2 as mentioned above, then the dummy data output pad group 664 of the data TCP 610 also has 42 dummy output pads (i.e., the 301st to 342nd output pads).

Figure 22:
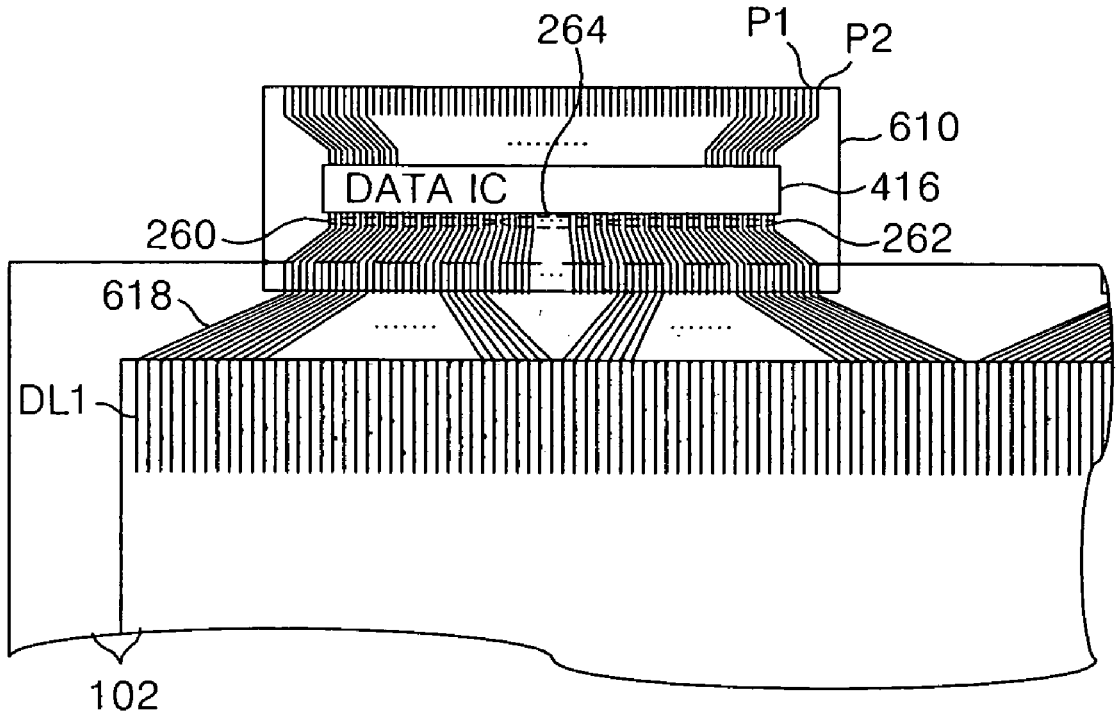
FIG. 22 illustrates a liquid crystal display panel onto which the data tape carrier package illustrated in FIG. 21 is attached.
Figure 23:
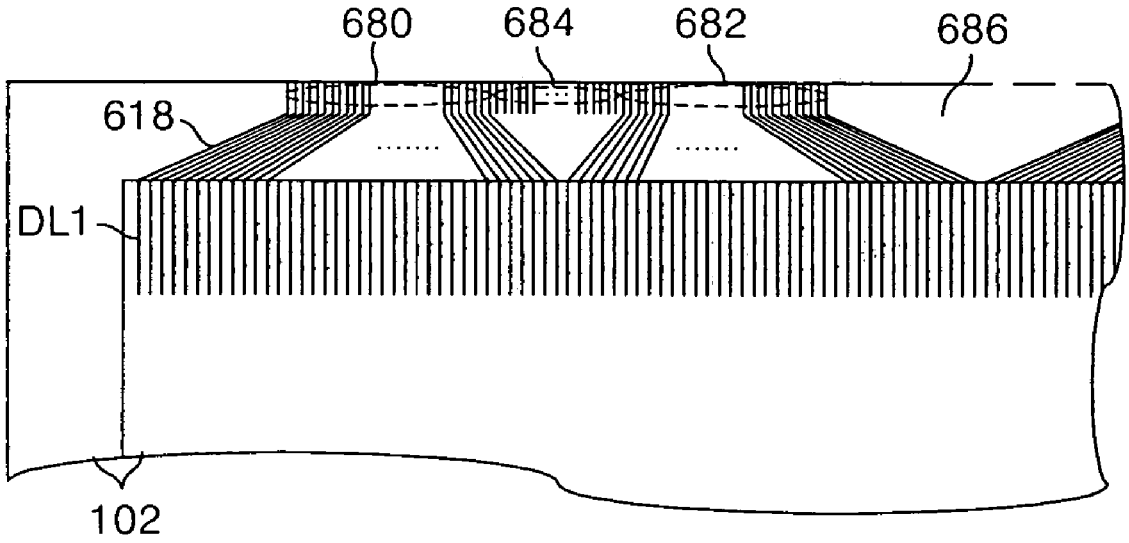
FIG. 23 illustrates the data pad part of the liquid crystal display panel illustrated in FIG. 22.

Such a data TCP 610 is attached to a data pad part 686 provided on the lower substrate of the liquid crystal display panel 102 illustrated in FIGS. 22 and 23.

The data pad part 686 is comprised of a first data input pad group 680 to which the first data output pad group 660 of the data TCP 610 is attached, a second data input pad group 682 to which the second data output pad group 662 of the data TCP 610 is attached, and a dummy data input pad group 684 to which the dummy data output pad group 664 of the data TCP 610 is attached and provided between the first and second data input pad groups 680 and 682.

The number of pads of the first data input pad group 680 becomes equal to that of the first data output pad group 660 of the data TCP 610. Each pad of the first data input pad group 680 is connected, via a link 618, to the data lines DL.

The number of pads of the second data input pad group 682 becomes equal to that of the second data output pad group 662 of the data TCP 610. Each pad of the second data input pad group 682 is connected, via the link 618, to the data lines DL.

The number of pads of the dummy data input pad group 684 becomes equal to that of the dummy data output pad group 664 of the data TCP 610. Each pad of the dummy data input pad group 684 is subject to being used as a dummy. In other words, the dummy data input pad group 684 is provided between the first and second data input pad groups 680 and 682 and is not connected to the data lines DL.

In an LCD according to the second embodiment of the present invention, the first and second data output pad groups 660 and 662 and the dummy data output pad group 664 of the data TCP 610 and the first and second data input pad groups 680 and 682 and the dummy data input pad group 684 of the liquid crystal display panel 102 are designed equally in such a manner to correspond to each channel of the first and second data output channel groups 260 and 262 and the dummy data output channel group 264 of the data IC 416 varied in response to the first and second output selection signals P1 and P2 as mentioned above.

The LCDs according to the first and second embodiments of the present invention as described above is not limited to only those varying output channels of the data IC's 116 and 416 each having 642 data output channels in response to the first and second channel selection signals P1 and P2, but is applicable to the data IC's 116 and 416 having 642 output channels or less and 642 output channels or more.

Furthermore, the output channels of the data IC's 116 and 416 set in response to the first and second channel selection signals P1 and P2 is not limited to only 600, 618, 630 and 642 data output channels, but is applicable to any cases. In other words, the output channels of the data IC's 116 and 416 set in response to the first and second channel selection signals P1 and P2 is determined depending upon any at least one of a resolution of the liquid crystal display panel 102, the number of data TCP's, a width of the data TCP and the number of data transmission lines between the timing controller 108 and the data IC's 116 and 416 for applying the pixel data from the timing controller 108 to the data IC's 116 and 416. Accordingly, the number of output channels of the data IC's 116 and 416 set in response to the first and second channel selection signals P1 and P2 may be 600, 618, 624, 630, 642, 645, 684, 696, 702 or 720, etc.

Moreover, the channel selection signals P1 and P2 for setting the output channels of the data IC's 116 and 416 is also not limited to a 2-bit binary logical value, but may be a binary logical value having more than two bits.

As described above, the LCD according to the present invention varies channels of the data integrated circuit in accordance with a resolution of the liquid crystal display panel using the channel selection signals, thereby driving all resolution of the liquid crystal display panel using a kind of data integrated circuit.

Furthermore, the LCD according to the present invention includes the data integrated circuit having the dummy data output channel group provided between the first and second data output channel groups for always applying a data to the data lines, and varies channels of the data integrated circuit depending upon a resolution of the liquid crystal display panel using the channel selection signals, thereby driving all resolutions of the liquid crystal display panel using a kind of data integrated circuit.

Accordingly, the LCD according to the present invention may use the data integrated circuit independently of a resolution of the liquid crystal display panel, thereby reducing the number of data integrated circuits. As a result, the LCD according to the present invention has improved operating efficiency as well as reduced manufacturing cost.

Although the present invention has been explained by the embodiments illustrated in the drawings described above, it should be understood to those skilled in the art that the invention is not limited to the above embodiments, but rather that various changes or modifications thereof are possible without departing from the spirit of the invention. Accordingly, the scope of the invention shall be determined only by the appended claims and their equivalents.

What is claimed is:

1. A chip mount film, comprising:

a data integrated circuit having a plurality of output channels;

a channel selector programmably selecting data output channels from the plurality of output channels to supply pixel data; and a tape carrier package mounted with the data integrated circuit and having output pads corresponding to the output channels of the data integrated circuit;

wherein non-selected output channels among the plurality of output channels are set as dummy output channels, wherein output pads of the tape carrier package comprise an output pad group connected to the data output channels and a dummy output pad group connected to the dummy output channels, and wherein the output pad group outputs said pixel data, and the dummy output pad group is disconnected from the data lines.

2. The chip mount film according to claim 1, further comprising:

a selection signal generator generating a channel selection signal for selecting the data output channels and then supplying the channel selection signal to the channel selector.

3. The chip mount film according to claim 2, wherein the dummy output channels and the dummy output pad group are floated.

4. The chip mount film according to claim 2, wherein the dummy output channels and the dummy output pad group are set to a constant voltage.

5. The chip mount film according to claim 1, wherein the output pads are connected to data lines of a liquid crystal display panel.

6. The chip mount film according to claim 2, wherein the selection signal generator generates the channel selection signal in accordance with at least one of a number of the data lines, a number of the data integrated circuits corresponding to a desired resolution of a display, a width of the tape carrier package mounted with the data integrated circuit and a number of input lines for the pixel data.

7. The chip mount film according to claim 2, wherein the channel selector is built-in the data integrated circuit, wherein the selection signal generator includes first and second selection terminals connected to a first voltage source and a second voltage source to generate the channel selection signal and supply the generated channel selection signal to the built-in channel selector.

8. The chip mount film according to claim 2, wherein the data integrated circuit includes:

a shift register portion for sequentially applying sampling signals;

a latch portion for latching pixel data in response to the sampling signals from the shift register portion;

a digital-to-analog converter for converting said pixel data from the latch portion to analog pixel data; and buffer means for buffering said pixel data from the digital-to-analog converter to provide said pixel data to a plurality of data lines.

9. The chip mount film according to claim 8, wherein the channel selector selects any one of I, J, K and L number (wherein I is an integer smaller than J, J is an integer smaller than K, and K is an integer smaller than L) of the data output channels.

10. The chip mount film according to claim 9, wherein said channel selector applies an output signal from one of W, X, Y and Z shift registers (where W, X, Y and Z are integers) corresponding to Ith, Jth, Kth and Lth data output channels to a next stage of a data driving integrated circuit.

11. The chip mount film according to claim 9, wherein the number of data output channels is programmable.

12. A chip mount film, comprising:

a data integrated circuit including a plurality of output channels divided into first and second output channel regions;

a channel selector selecting first and second data output channel groups from each of the first and the second output channel regions to supply pixel data; and a tape carrier package mounted with the data integrated circuit and having output pads corresponding to the first and second output channel regions, wherein non-selected output channels are dummy output channels of the plurality of output channels and are located between the first and the second data output channel regions, wherein the output pads of the tape carrier package include a data output pad group connected to the first and the second data output channels and a dummy output pad group connected to the dummy output channels, and wherein the data output pad group outputs said pixel data, and the dummy output pad group is disconnected from the data lines.

13. The chip mount film according to claim 12, further comprising:

a selection signal generator generating a channel selection signal to select the first and the second data output channel groups to supply the channel selection signal to the channel selector.

14. The chip mount film according to claim 13, wherein the dummy output channels and the dummy output pad group are floated.

15. The chip mount film according to claim 14, wherein the dummy output channels and the dummy output pad group are set to a constant voltage.

16. The chip mount film according to claim 13, wherein the selection signal generator generates the channel selection signal in accordance with at least one of a number of the data lines, a number of the data integrated circuits corresponding to a desired resolution of a display, a width of the tape carrier package mounted with the data integrated circuit and a number of input lines for the pixel data.

17. The chip mount film according to claim 13, wherein the channel selector is built-in the data integrated circuit, wherein the selection signal generator includes first and second selection terminals connected to a first voltage source and a second voltage source to generate the channel selection signal and supply the generated channel selection signal to the built-in channel selector.

18. The chip mount film according to claim 12, wherein the data integrated circuit includes:

shift registers for sequentially applying sampling signals;

a latch portion for latching pixel data in response to the sampling signals from the shift registers;

a digital-to-analog converter for converting the pixel data from the latch portion to analog pixel data; and buffer means for buffering the pixel data from the digital-to-analog converter to provide said pixel data to a plurality of data lines.

19. The chip mount film according to claim 12, wherein the data integrated circuit includes:

a shift register unit having N shift registers (where N is a positive integer) shifting a start pulse signal to generate a sequential sampling signal;

a latch unit for latching the pixel data in response to the sampling signal from the shift register unit; and a digital-to-analog converter converting the pixel data from the latch to analog pixel data.

20. The chip mount film according to claim 12, wherein the first and the second data output channel groups have a same number of output channels.

21. The data driving integrated circuit according to claim 12, wherein the first data output channel group includes a first output channel of the plurality of output channels to one of I1th, I2th and I3th output channels, wherein I1 is an integer larger than 1, I2 is an integer larger than I1, and I3 is an integer larger than I2 and smaller than N (where N is a number of output channels).

22. The data driving integrated circuit according to claim 21, wherein the second data output channel group includes one of J1th, J2th and J3th output channels of the plurality of output channels, wherein J1is an integer larger than I3, J2 is an integer larger than J1, J3 is an integer larger than J2 and smaller than N.

23. The data driving integrated circuit according to claim 22, wherein any one of the (I1+1)th to (J3−1)th, the (I2+1)th to (J2−1)th and the (I3+1)th to (J1−1)th of the output channels is a dummy output channel group.

24. A liquid crystal display device comprising:

a data integrated circuit having a plurality of output channels;

a channel selector selecting data output channels from the plurality of output channels to supply pixel data, wherein non-selected output channels of the plurality of output channels are dummy channels;

a tape carrier package mounted with the data integrated circuit and having data output pads connected to the data output channels and dummy output pads connected to the dummy channels; and a liquid crystal display panel including data lines connected to the data output pads of the tape carrier package;

wherein the data output pads output said pixel data, and the dummy output pads are disconnected to the data lines.

25. The liquid crystal display device according to claim 24, wherein the number of data output channels is programmable.

26. The liquid crystal display device according to claim 24, further comprising:

a selection signal generator generating a channel selection signal for selecting the data output channels and then supplying the channel selection signal to the channel selector.

27. The liquid crystal display device according to claim 24, wherein the liquid crystal display panel further includes data input pads connected between the data output pads and the data lines.

28. The liquid crystal display device according to claim 27, wherein the liquid crystal display panel further includes dummy input pads connected to the dummy output pads.

29. The liquid crystal display device according to claim 28, wherein the dummy channels, the dummy output pads and the dummy input pads are floated.

30. The liquid crystal display device according to claim 28, wherein the dummy channels, the dummy output pads and the dummy input pads are set to a constant voltage.

31. A liquid crystal display device comprising:

a data integrated circuit including a plurality of output channels divided into first and second output channel groups;

a channel selector selecting first and second data output channel groups from each of the first and the second output channel groups to supply pixel data, wherein non-selected output channels of the plurality of output channels are dummy channels that are not supplied with pixel data and are located between the first and the second data output channel groups;

a tape carrier package mounted with the data integrated circuit and having data output pads connected to the first and the second data output channel groups and dummy output pads connected to the dummy channels; and a liquid crystal display panel having data lines connected to the data output pads of the tape carrier package;

wherein the data output pads output said pixel data, and the dummy output pads are disconnected from the data lines.

32. The liquid crystal display device according to claim 31, further comprising:

a selection signal generator generating a channel selection signal for selecting the data output channel groups and then supplying the channel selection signal to the channel selector.

33. The liquid crystal display device according to claim 31, wherein the liquid crystal display panel further includes data input pads connected between the data output pads and the data lines.

34. The liquid crystal display device according to claim 33, wherein the liquid crystal display panel further includes dummy input pads connected to the dummy output pads.

35. The liquid crystal display device according to claim 34, wherein the dummy channels, the dummy output pads and the dummy input pads are floated.

36. The liquid crystal display device according to claim 34, wherein the dummy output pads and the dummy input pads are set to a constant voltage.

37. The liquid crystal display device according to claim 31, wherein the data output channel groups are programmable.

* * * * *